US008745911B2

(12) United States Patent
Zheng

(10) Patent No.: US 8,745,911 B2
(45) Date of Patent: Jun. 10, 2014

(54) BOLT ASSEMBLY AND BOLT CARRIER ASSEMBLY WITH SWITCH MECHANISM FOR DISCHARGING SPENT CASING FROM EITHER SIDE OF FIREARM RECEIVER WITHOUT NEED OF DISASSEMBLING THE FIREARM

(71) Applicant: Jing Zheng, Hamburg (DE)

(72) Inventor: Jing Zheng, Hamburg (DE)

( * ) Notice: Subject to any disclaimer, the term of this patent is extended or adjusted under 35 U.S.C. 154(b) by 71 days.

(21) Appl. No.: 13/658,700

(22) Filed: Oct. 23, 2012

(65) Prior Publication Data

US 2013/0125440 A1 May 23, 2013

Related U.S. Application Data

(60) Provisional application No. 61/561,208, filed on Nov. 17, 2011.

(51) Int. Cl.
*F41A 15/00* (2006.01)

(52) U.S. Cl.
USPC ..... 42/25; 42/16

(58) Field of Classification Search
CPC ..... F41A 3/26; F41A 3/66; F41A 15/14; F41A 35/06; F41A 3/30
USPC ..... 42/14–16, 25, 39.5, 47, 46, 69.02, 106; 89/4.1, 11
See application file for complete search history.

(56) References Cited

U.S. PATENT DOCUMENTS

| | | | | |
|---|---|---|---|---|
| 2,481,548 | A | 9/1949 | Waltke | |
| 3,791,060 | A * | 2/1974 | Weaver | 42/16 |
| 3,882,625 | A * | 5/1975 | Tellie | 42/25 |
| 3,952,440 | A * | 4/1976 | Tellie | 42/106 |
| 3,999,318 | A | 12/1976 | Tellie | |
| 4,191,089 | A | 3/1980 | Zedrosser | |
| 5,412,894 | A | 5/1995 | Moon | |
| 5,502,914 | A | 4/1996 | Moon | |
| 5,675,924 | A | 10/1997 | Predazzer | |
| 6,523,293 | B2 | 2/2003 | Murello et al. | |
| 6,536,150 | B2 | 3/2003 | Schweikart | |
| 6,625,917 | B2 * | 9/2003 | Murello et al. | 42/16 |
| 6,966,137 | B2 * | 11/2005 | Gussalli Beretta | 42/46 |
| 7,331,135 | B2 | 2/2008 | Shimi | |
| 7,395,626 | B2 * | 7/2008 | Zedrosser | 42/25 |

(Continued)

FOREIGN PATENT DOCUMENTS

| | | |
|---|---|---|
| CH | 580269 | 8/1976 |
| DE | 2443044 | 4/1975 |

*Primary Examiner* — Samir Abdosh
*Assistant Examiner* — John D Cooper
(74) *Attorney, Agent, or Firm* — Han IP Corporation; Andy M. Han

(57) ABSTRACT

A bolt assembly comprises: a bolt front half piece having an extractor slot through which the spent casing is ejected; a bolt rear half piece; an elastic body; and a bolt interlock received in the bolt rear half piece and movable longitudinally with respect to the bolt rear half piece. The elastic body is disposed between the bolt interlock and the bolt rear half piece when the bolt front half piece and the bolt rear half piece are mated together. When the bolt interlock is in a first position, the bolt front half piece is interlocked axially with respect to the bolt rear half piece with the extractor slot pointing in a first direction. When the bolt interlock is in a second position, the bolt front half piece is rotatable axially with respect to the bolt rear half piece so that the extractor slot can point in a second direction.

21 Claims, 14 Drawing Sheets

(56) References Cited

U.S. PATENT DOCUMENTS

| | | | | |
|---|---|---|---|---|
| 7,819,052 | B2 | 10/2010 | Zedrosser | |
| 7,849,777 | B1 | 12/2010 | Zedrosser | |
| 2010/0300278 | A1 | 12/2010 | Zedrosser | |
| 2011/0232149 | A1 * | 9/2011 | Fargnoli et al. | 42/16 |

* cited by examiner

BOLT ASSEMBLY AND BOLT CARRIER ASSEMBLY WITH SWITCH MECHANISM FOR DISCHARGING SPENT CASING FROM EITHER SIDE OF FIREARM RECEIVER WITHOUT NEED OF DISASSEMBLING THE FIREARM

CROSS REFERENCE TO RELATED PATENT APPLICATION

The present application claims the priority benefit to U.S. Provisional Patent Application No. 61/561,208, filed on Nov. 17, 2011, which is hereby incorporated by reference in its entirety.

BACKGROUND

1. Technical Field

The present disclosure generally relates to firearms. More specifically, the present disclosure relates to a bolt assembly and bolt carrier assembly with switch mechanism that enables discharging of spent bullet casings from either the left side or the right side of the rifle receiver without the need of disassembling the firearm.

2. Description of Related Art

Presently there are several approaches that enable firearms to discharge spent bullet casings, or cartridges, from either of both sides of the firearm. However, there are one or more shortcomings associated with each of these approaches, including the need to disassemble the firearm for reconfiguration to enable the discharging of spent casings from one side of the firearm to the other.

A first approach, described in Swiss Patent No. CH580269A, relates to a bullpup rifle designed for the purpose of discharging spent casings from either of both sides of the firearm. This approach uses a multi-lug rotating bolt design. Although this approach allows the change of direction out of which spent casings are discharged, disassembling of the firearm is necessary to reconfigure the firearm to enable the discharging of spent casings from one side of the firearm to the other.

A second approach, described in U.S. Pat. No. 7,331,135B2, relates to a bullpup rifle designed for the purpose of discharging spent casings from either of both sides of the firearm. Similarly, this approach uses a multi-lug rotating bolt design. Although this approach allows the change of direction out of which spent casings are discharged, disassembling of the firearm is necessary to reconfigure the firearm to enable the discharging of spent casings from one side of the firearm to the other.

A third approach, described in U.S. Pat. No. 5,675,924, relates to a bullpup rifle designed for the purpose of discharging spent casings to the front of the firearm. Accordingly, this approach does not require any adjustment of the firearm when an operator changes from left-hand firing to right-hand firing of the firearm, and vice versa. This may be preferable to other designs from the perspective of ease for the operator's selection and changing of the firing hand. However, such design tends to retain some spent casings inside the firearm, thereby introducing higher possibility of jamming the firearm. Furthermore, as this design has less open port on the firearm receiver, when jamming does occur it is very difficult for the operator to access the jammed casing and clear the jam.

A fourth approach, described in U.S. Pat. Nos. 7,849,777, 7,819,052 and 7,395,626 and U.S. Patent Application Publication No. 20100300278, relates to a conventional rifle design with a stock. This approach allows spent casings to be discharged from either the left side or the right side of the firearm by the operator pushing a switch mechanism located inside the firearm with a tool. No disassembling of the rifle is necessary. The tool may be a screw driver or a rifle ammo cartridge, for example. However, those tools are not necessarily installed on the firearm. This approach uses a multi-lug rotating bolt design and tends to have quite an amount of material at the bolt head machined away to allow switching of the discharging side to be possible. Therefore, the bolt head strength may be unnecessarily weakened.

A fifth approach, described in U.S. Pat. No. 3,882,625, relates to a bullpup rifle designed for the purpose of discharging spent casings from either of both sides of the firearm. This approach uses a multi-lug rotating design. However, although the direction in which spent casings are discharged can be switched, disassembling of the firearm is necessary.

The standard AR15 design includes a bolt assembly and a bolt carrier assembly with the bolt assembly disposed inside the bolt carrier assembly. FIG. 1A illustrates a standard AR15 bolt assembly 10 which comprises cam pin hole 11, extractor 12, multi-lug bolt head 13, ejector 14 and reinforcement lug 15. FIG. 1B illustrates a standard AR15 barrel extension 20 which comprises eight locking lugs 21. In order to avoid obscuring the illustration and to promote better viewing, certain components are not illustrated such as, for example, extractor pin, ejector spring, ejector retaining pin, etc. The bolt assembly 10 is assembled and disposed inside a bolt carrier. The bolt assembly 10 uses a multi-lug bolt head 13, with seven evenly-distributed lugs (with the eighth one missing in exchange of extractor slot), to lock with seven out of eight available locking lugs 21 on a barrel extension 20 when firing. After firing, the bolt assembly 10 will turn 22.5 degrees under the guide of the cam pin on the bolt carrier (not shown) through the cam pin hole 11, such that it will unlock with the barrel extension 20 to allow the spent bullet casing to be extracted by the extractor 12 and ejected from the rifle receiver by the ejector 14. The direction of ejection is from the ejector position pointing toward the extractor position.

The AR15 bolt assembly 10, looking in the direction from head to tail, is like a gear with eight square teeth. On the extractor slot where the extractor 12 is resided, one tooth is missing from the bolt body. However, the reinforcement lug 15 on the extractor 12 is positioned at the location of the missing locking lug, with somewhat shortened height. Hence, with necessary enhanced design, it is possible to use another gear-shaped piece to turn the bolt assembly according to its axis to change the ejection direction of the spent bullet casing.

However, standard AR15 can only allow spent casings to eject from the right side of the rifle. This is due to the fact that the cam pin hole 11 is restricted by the cam pin (not shown) sliding inside a groove on the upper receiver (not shown) of the rifle. Some custom made AR15 can be made to only allow the spent casing to eject from the left side of the rifle. Interchanging the ejection direction on such rifle, however, is not possible.

SUMMARY

The present disclosure is directed to a bolt and bolt carrier assembly with switch mechanism that enables discharging of spent bullet casings from either the left side or the right side of the rifle receiver without the need of disassembling the firearm.

According to one aspect, a bolt assembly for use in a firearm that is capable of selectively ejecting a spent casing in either a first ejection direction or a second ejection direction is provided. The bolt assembly may comprise: a bolt front half piece capable of extracting and ejecting the spent casing; a bolt rear half piece configured to mate with the bolt front half piece; an elastic body received in the bolt rear half piece; and a bolt interlock received in the bolt rear half piece and movable longitudinally with respect to the bolt rear half piece. When the bolt front half piece and the bolt rear half piece are mated together the elastic body may be disposed between the bolt interlock and the bolt rear half piece. When the bolt interlock is in a first bolt interlock position, the bolt front half piece may be interlocked axially with respect to the bolt rear half piece by the bolt interlock to eject the spent casing in the first ejection direction. When the bolt interlock is in a second bolt interlock position, the bolt front half piece may be rotatable axially with respect to the bolt rear half piece to eject the spent casing in the second ejection direction which is different from the first ejection direction.

In some embodiments, when in the second bolt interlock position, the bolt interlock functions as a disposition safety to distance a firing pin of the firearm away from an ammunition primer in an event the bolt assembly is in a battery position with a barrel extension of the firearm.

In some embodiments, the bolt front half piece may further comprise: a bolt head defined at a first end of the bolt front half piece; a plurality of position lugs defined at a second end of the bolt front half piece opposite the first end; and a raised shoulder circling a circumference of the bolt front half piece and defined between the extractor slot and the position lugs.

In some embodiments, the bolt interlock may comprise a body and a plurality of interlocking lugs at the first end of the body with a plurality of grooves defined therebetween. The body may be generally cylindrical in shape and may have a first end and a second end opposite the first end. The first end may be in contact with the bolt front half piece when the bolt interlock is in the first bolt interlock position. The grooves between the interlocking lugs may receive the position lugs of the bolt front half piece to interlock the bolt front half piece axially with respect to the bolt rear half piece when the bolt interlock is in the first bolt interlock position.

In some embodiments, the bolt rear half piece may be generally cylindrical in shape and hollow. A first end of the bolt rear half piece that mates with the bolt front half piece may have an opening that receives the bolt interlock. The bolt rear half piece may have a plurality of longitudinal openings extending from the opening at the first end toward a second end opposite the first end for a portion of a length of the bolt rear half piece so that the interlocking lugs of the bolt interlock slide in the longitudinal openings when the bolt interlock move between the first bolt interlock position and the second bolt interlock position.

In some embodiments, the bolt front half piece may comprise three position lugs, and the bolt interlock may comprise three interlocking lugs.

In some embodiments, the elastic body may comprise a spring.

According to another aspect, a bolt and bolt carrier assembly for use in a firearm that is capable of selectively ejecting a spent casing in either a first ejection direction or a second ejection direction is provided. The bolt and bolt carrier assembly may comprise a bolt assembly and a bolt carrier assembly in which the bolt assembly is received. The bolt assembly may comprise: a bolt front half piece having an extractor slot through which the spent casing is ejected; a bolt rear half piece configured to mate with the bolt front half piece; an elastic body received in the bolt rear half piece; and a bolt interlock received in the bolt rear half piece with the elastic body disposed between the bolt interlock and the bolt rear half piece. The bolt interlock may be movable longitudinally with respect to the bolt rear half piece. The bolt carrier assembly may be configured such that the bolt assembly is movable axially and longitudinally with respect to the bolt carrier assembly between a first bolt assembly position and a second bolt assembly position to allow firing of the firearm when the bolt assembly is in the second bolt assembly position.

In some embodiments, when the bolt interlock is in a first bolt interlock position, the bolt front half piece may be interlocked axially with respect to the bolt rear half piece by the bolt interlock with the extractor slot pointing in the first ejection direction. Further, when the bolt interlock is in a second bolt interlock position, the bolt front half piece may be rotatable axially with respect to the bolt rear half piece so that the extractor slot can point in the second ejection direction which is different from the first ejection direction.

In some embodiments, the bolt front half piece may further comprise: a bolt head defined at a first end of the bolt front half piece; a plurality of position lugs defined at a second end of the bolt front half piece opposite the first end; and a raised shoulder circling a circumference of the bolt front half piece and defined between the extractor slot and the position lugs.

In some embodiments, the bolt interlock may comprise a body and a plurality of interlocking lugs at the first end of the body with a plurality of grooves defined therebetween. The body may be generally cylindrical in shape and may have a first end and a second end opposite the first end. The first end may be in contact with the bolt front half piece when the bolt interlock is in the first bolt interlock position. The grooves between the interlocking lugs may receive the position lugs of the bolt front half piece to interlock the bolt front half piece axially with respect to the bolt rear half piece when the bolt interlock is in the first bolt interlock position.

In some embodiments, the bolt rear half piece may be generally cylindrical in shape and hollow. A first end of the bolt rear half piece that mates with the bolt front half piece may have an opening that receives the bolt interlock. The bolt rear half piece may have a plurality of longitudinal openings extending from the opening at the first end toward a second end opposite the first end for a portion of a length of the bolt rear half piece so that the interlocking lugs of the bolt interlock slide in the longitudinal openings when the bolt interlock move between the first bolt interlock position and the second bolt interlock position.

In some embodiments, the bolt front half piece may comprise three position lugs, and the bolt interlock may comprise three interlocking lugs.

In some embodiments, the elastic body may comprise a spring.

In some embodiments, the bolt carrier assembly may comprise: a bolt carrier, a cam pin, a bolt interlock push pin, a firing pin, and a firing pin retaining pin. The bolt carrier may have a bolt hole in which the bolt assembly is received. The bolt carrier may further have a cam groove and a clearance groove defined therein such that the cam groove and the clearance groove connect the bolt hole and an outer circumferential surface of the bolt carrier. The cam pin may be movably received in the cam groove of the bolt carrier. The bolt interlock push pin may be movably received in the clearance groove of the bolt carrier. The cam groove and the clearance groove may be shaped such that the cam pin and the bolt interlock push pin can move axially and longitudinally with respect to the bolt carrier when the cam pin and the bolt interlock push pin are received in the cam groove and the clearance groove, respectively.

In some embodiments, the bolt rear half piece may further include a cam pin hole in which the cam pin, received in the cam groove of the bolt carrier, is inserted. The cam pin may include a clearance hole that receives the bolt interlock when the cam pin is inserted in the cam pin hole of the bolt rear half piece through the cam groove of the bolt carrier. The bolt interlock may further include a bolt interlock push pin hole in which the bolt interlock push pin, received in the clearance groove of the bolt carrier, is inserted.

In some embodiments, the bolt carrier assembly may further comprise a firing pin. The bolt interlock push pin may include a clearance hole that receives the firing pin when the bolt interlock push pin is inserted in the bolt interlock push pin hole of the bolt interlock through the clearance groove of the bolt carrier.

According to still another aspect, a firearm capable of selectively ejecting a spent casing in either a first ejection direction or a second ejection direction is provided. The firearm may comprise a bolt assembly, a bolt carrier assembly in which the bolt assembly is received, and a switch mechanism. The bolt assembly may comprise: a bolt front half piece having an extractor slot through which the spent casing is ejected; a bolt rear half piece configured to mate with the bolt front half piece; an elastic body received in the bolt rear half piece; and a bolt interlock received in the bolt rear half piece with the elastic body disposed between the bolt interlock and the bolt rear half piece, the bolt interlock movable longitudinally with respect to the bolt rear half piece. The bolt carrier assembly may be configured such that the bolt assembly is movable axially and longitudinally with respect to the bolt carrier assembly between a first bolt assembly position and a second bolt assembly position to allow firing of the firearm when the bolt assembly is in the second bolt assembly position. The switch mechanism may be coupled to rotate the bolt front half piece axially with respect to the bolt carrier assembly.

In some embodiments, when the bolt interlock is in a first bolt interlock position, the bolt front half piece may be interlocked axially with respect to the bolt rear half piece by the bolt interlock with the extractor slot pointing in the first ejection direction. Moreover, when the bolt interlock is in a second bolt interlock position, the bolt front half piece may be rotatable axially with respect to the bolt rear half piece so that the extractor slot can point in the second ejection direction which is different from the first ejection direction.

In some embodiments, the bolt front half piece may further comprise: a bolt head defined at a first end of the bolt front half piece; a plurality of position lugs defined at a second end of the bolt front half piece opposite the first end; and a raised shoulder circling a circumference of the bolt front half piece and defined between the extractor slot and the position lugs.

In some embodiments, the bolt interlock may comprise a body and a plurality of interlocking lugs at the first end of the body with a plurality of grooves defined therebetween. The body may be generally cylindrical in shape and may have a first end and a second end opposite the first end. The first end may be in contact with the bolt front half piece when the bolt interlock is in the first bolt interlock position. The grooves between the interlocking lugs may receive the position lugs of the bolt front half piece to interlock the bolt front half piece axially with respect to the bolt rear half piece when the bolt interlock is in the first bolt interlock position.

In some embodiments, the bolt rear half piece may be generally cylindrical in shape and hollow. A first end of the bolt rear half piece that mates with the bolt front half piece may have an opening that receives the bolt interlock. The bolt rear half piece may have a plurality of longitudinal openings extending from the opening at the first end toward a second end opposite the first end for a portion of a length of the bolt rear half piece so that the interlocking lugs of the bolt interlock slide in the longitudinal openings when the bolt interlock move between the first bolt interlock position and the second bolt interlock position.

In some embodiments, the bolt front half piece may comprise three position lugs, and the bolt interlock may comprise three interlocking lugs.

In some embodiments, the elastic body may comprise a spring.

In some embodiments, the bolt carrier assembly may comprise: a bolt carrier, a cam pin, a bolt interlock push pin, a firing pin, and a firing pin retaining pin. The bolt carrier may have a bolt hole in which the bolt assembly is received. The bolt carrier may further have a cam groove and a clearance groove defined therein such that the cam groove and the clearance groove connect the bolt hole and an outer circumferential surface of the bolt carrier. The cam pin may be movably received in the cam groove of the bolt carrier. The bolt interlock push pin may be movably received in the clearance groove of the bolt carrier. The cam groove and the clearance groove may be shaped such that the cam pin and the bolt interlock push pin can move axially and longitudinally with respect to the bolt carrier when the cam pin and the bolt interlock push pin are received in the cam groove and the clearance groove, respectively.

In some embodiments, the bolt rear half piece may further include a cam pin hole in which the cam pin, received in the cam groove of the bolt carrier, is inserted. The cam pin may include a clearance hole that receives the bolt interlock when the cam pin is inserted in the cam pin hole of the bolt rear half piece through the cam groove of the bolt carrier. The bolt interlock may further include a bolt interlock push pin hole in which the bolt interlock push pin, received in the clearance groove of the bolt carrier, is inserted.

In some embodiments, the bolt carrier assembly may further comprise a firing pin. The bolt interlock push pin may include a clearance hole that receives the firing pin when the bolt interlock push pin is inserted in the bolt interlock push pin hole of the bolt interlock through the clearance groove of the bolt carrier.

In some embodiments, the switch mechanism may comprise: an upper receiver; a bolt gear configured to be engaged to the bolt front half piece to rotate the bolt front half piece axially with respect to the bolt carrier assembly; and a first cheekpiece bracket to which the bolt gear is attached. The first cheekpiece bracket may have two retention holes. The first cheekpiece bracket may be rotatably coupled to the upper receiver such that, when the bolt gear and the bolt front half piece are engaged, by turning the first cheekpiece bracket, the bolt gear turns the bolt front half piece to point the extractor in a direction between the first ejection direction and the second ejection direction.

In some embodiments, the switch mechanism may further comprise a second cheekpiece bracket, a switch rod, a first switch block, a second switch block, and a switch slide. The second cheekpiece bracket may be rotatably coupled to the upper receiver. The second cheekpiece bracket may have two retention holes. The switch rod may be coupled to move longitudinally with respect to the firearm over the upper receiver. The first switch block may be coupled to the switch rod and may have two locking pins. The second switch block may be coupled to the switch rod and may have two locking pins. The switch slide may be coupled to the switch rod to move longitudinally with respect to the firearm between a first switch slide position and a second switch slide position. When the switch slide is in the first switch slide position, one of the locking pins of the first switch block and one of the locking pins of the second switch block on the same side may be respectively inserted in the respective one of the retention holes of the first cheekpiece bracket and the second cheekpiece bracket, as well as the correspondent retention holes on the upper receiver, to lock the first and second cheekpiece brackets with the upper receiver. When the switch slide is in the second switch slide position, the active locking pin of the first switch block and the active locking pin of the second switch block may be pulled out of the respective one of the retention holes of the first cheekpiece bracket and the second cheekpiece bracket, as well as the respective retention holes on the upper receiver, to allow the first cheekpiece bracket and the second cheekpiece bracket to rotate.

These and other objectives of the present disclosure will be appreciated by those of ordinary skill in the art after reading the following detailed description of the preferred embodiments that are illustrated in the various figures and drawings.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Overview

Figure 1B:
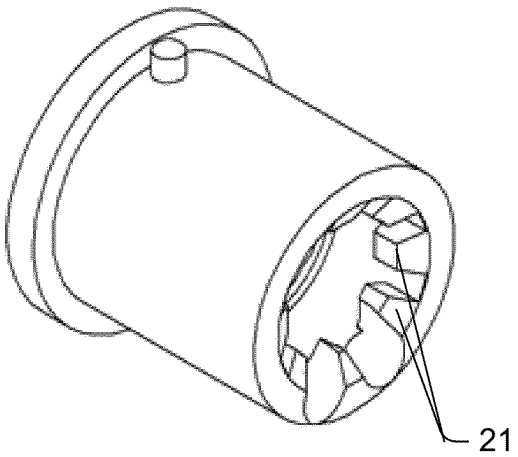
FIG. 1B (PRIOR ART)
FIG. 1B is a perspective view of a standard AR15 barrel extension.

Various embodiments of the present disclosure relate to a bolt and bolt carrier assembly with switch mechanism that enables discharging of spent bullet casings from either the left side or the right side of the rifle receiver without the need of disassembling the firearm. As the design has one ejection ports on each side of the firearm, it is easier for an operator to access a jammed casing to clear it compared to existing designs.

Examples provided in the present disclosure are based on the standard AR15 barrel extension and bolt head design, which have been used in the U.S. and numerous other countries for more than 40 years and hence battle proven. The AR15 is one of the most popular rifles in the civilian market, and spare parts are relatively easier to find. Nevertheless, those ordinarily skilled in the art would appreciate the applicability of the present disclosure in firearms other than the AR15. In other words, the scope of the present disclosure is not limited to AR15 but, rather, extends to any presently available firearm and any firearm conceived in the future in which the concept of the present disclosure can be implemented.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

Example Embodiments of a Bolt Assembly

According to various embodiments, a bolt assembly for use in a firearm that is capable of selectively ejecting a spent casing in either a first ejection direction or a second ejection direction is provided. The bolt assembly may comprise: a bolt front half piece capable of extracting and ejecting the spent casing; a bolt rear half piece configured to mate with the bolt front half piece; an elastic body received in the bolt rear half piece; and a bolt interlock received in the bolt rear half piece and movable longitudinally with respect to the bolt rear half piece. When the bolt front half piece and the bolt rear half piece are mated together the elastic body may be disposed between the bolt interlock and the bolt rear half piece. When the bolt interlock is in a first bolt interlock position, the bolt front half piece may be interlocked axially with respect to the bolt rear half piece by the bolt interlock to eject the spent casing in the first ejection direction. When the bolt interlock is in a second bolt interlock position, the bolt front half piece may be rotatable axially with respect to the bolt rear half piece to eject the spent casing in the second ejection direction which is different from the first ejection direction.

In some embodiments, when in the second bolt interlock position, the bolt interlock functions as a disposition safety to distance a firing pin of the firearm away from an ammunition primer in an event the bolt assembly is in a battery position with a barrel extension of the firearm.

In some embodiments, the bolt front half piece further comprises a bolt head, a plurality of position lugs, and a raised shoulder. The bolt head is defined at a first end of the bolt front half piece. The position lugs are defined at a second end of the bolt front half piece opposite the first end. The raised shoulder circles a circumference of the bolt front half piece and is defined between the extractor slot and the position lugs.

In some embodiments, the bolt interlock comprises a body and a plurality of interlocking lugs at the first end of the body with a plurality of grooves defined therebetween. The body is generally cylindrical in shape and has a first end and a second end opposite the first end. The first end of the body is in contact with the bolt front half piece when the bolt interlock is in the first bolt interlock position. The grooves between the interlocking lugs receive the position lugs of the bolt front half piece to interlock the bolt front half piece axially with respect to the bolt rear half piece when the bolt interlock is in the first bolt interlock position.

In some embodiments, the bolt rear half piece is generally cylindrical in shape and hollow. A first end of the bolt rear half piece that mates with the bolt front half piece has an opening that receives the bolt interlock. The bolt rear half piece has a plurality of longitudinal openings extending from the opening at the first end toward a second end opposite the first end for a portion of a length of the bolt rear half piece so that the interlocking lugs of the bolt interlock slide in the longitudinal openings when the bolt interlock move between the first bolt interlock position and the second bolt interlock position.

In some embodiments, the bolt front half piece comprises three position lugs, and the bolt interlock may comprise three interlocking lugs.

In some embodiments, the elastic body comprises a spring.

Figure 2:
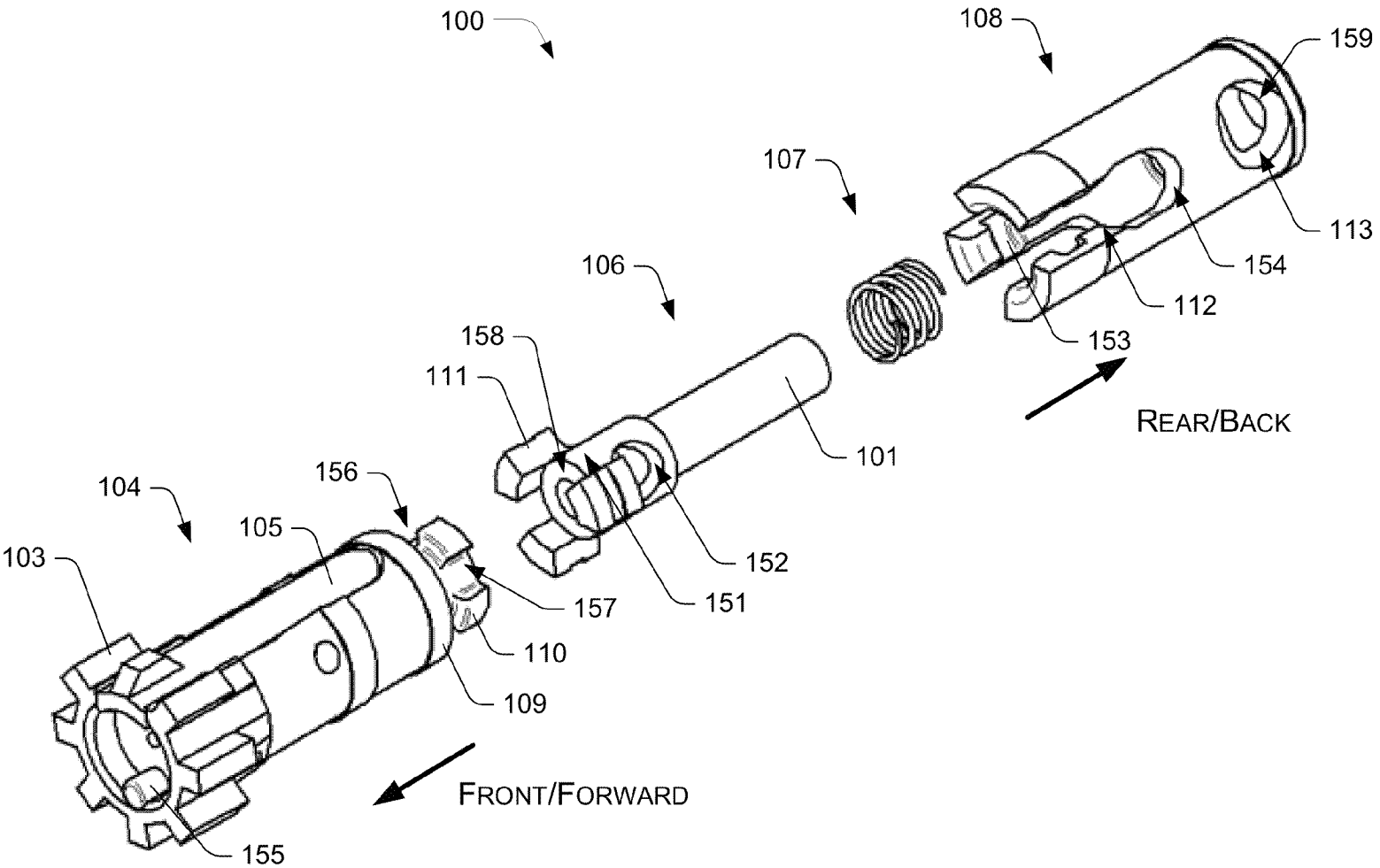
FIG. 2 is an exploded view of a bolt assembly in accordance with an embodiment of the present disclosure.
Figure 3A:
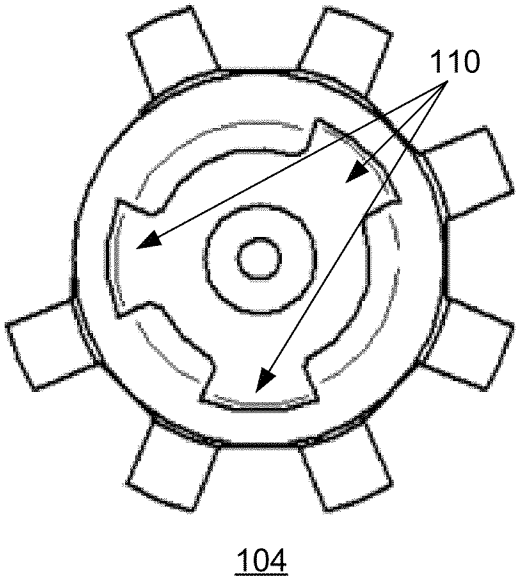
FIG. 3A is a tail view of the front half of a bolt in a left discharge position in accordance with an embodiment of the present disclosure.
Figure 3B:
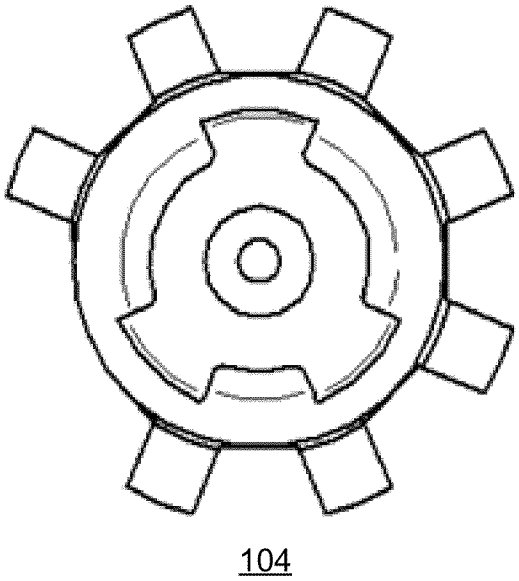
FIG. 3B is a tail view of the front half of a bolt in an assemble/disassemble position in accordance with an embodiment of the present disclosure.
Figure 3C:
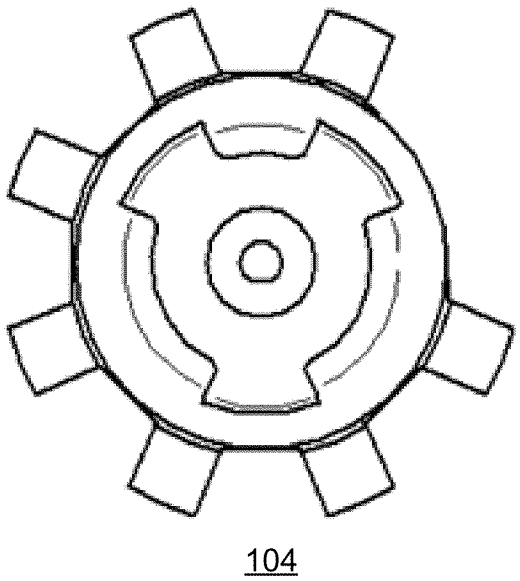
FIG. 3C is a tail view of the front half of a bolt in a right discharge position in accordance with an embodiment of the present disclosure.
Figure 4B:
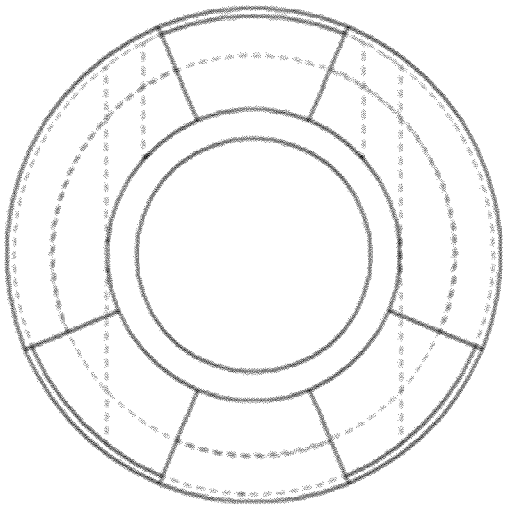
FIG. 4B is a front view of a bolt rear half in accordance with an embodiment of the present disclosure.
Figure 4A:
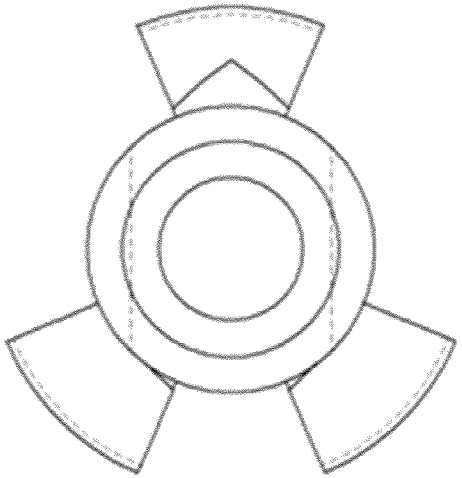
FIG. 4A is a tail view of a bolt interlock in accordance with an embodiment of the present disclosure.

FIG. 2 illustrates a bolt assembly 100 in accordance with an embodiment of the present disclosure. FIGS. 3A-3C each illustrates a tail view of the front half of a bolt in a respective position in accordance with an embodiment of the present disclosure. FIG. 4A is a tail view of a bolt interlock in accordance with an embodiment of the present disclosure. FIG. 4B is a front view of a bolt rear half in accordance with an embodiment of the present disclosure. Reference will be made to these Figures in the description below.

In the embodiment illustrated in FIG. 2, the bolt assembly 100 is derived from the AR15 bolt design and comprises four major parts to maintain the bolt assembly function of the AR15 bolt design. Additionally, the bolt assembly 100 offers the ability for the bolt head to turn to change the direction of ejection of spent bullet casings. The bolt assembly 100 comprises the four major parts of a bolt front half piece 104, a bolt interlock 106, a bolt interlock return spring 107, and a bolt rear half piece 108. The bolt front half piece 104 comprises a bolt head 103, an ejector 155, an extractor 105, a raised shoulder 109, and a three-position lugs 110. The bolt interlock 106 comprises a body 101, a bolt interlock push pin hole 152, and three interlocking lugs 111 with three grooves 151 each defined between two adjacent interlocking lugs 111. The bolt rear half piece 108 is generally cylindrical in shape and hollow, and comprises a cam pin hole 113.

A first end of the bolt rear half piece 108 that mates with the bolt front half piece 104 has an opening that receives the bolt interlock 106. The bolt rear half piece 108 three longitudinal openings 112 extending from the opening at the first end toward a second end opposite the first end for a portion of a length of the bolt rear half piece 108 so that the interlocking lugs 111 of the bolt interlock 106 slide in the longitudinal openings 112 when the bolt interlock 106 move between a first bolt interlock position and a second bolt interlock position. The circumferential grooves 153 on the bolt rear half piece 108 receive the position lugs 110 on the bolt front half piece 104, so that the bolt front half piece 104 will not move relative to the bolt rear half piece longitudinally.

Figure 1A:
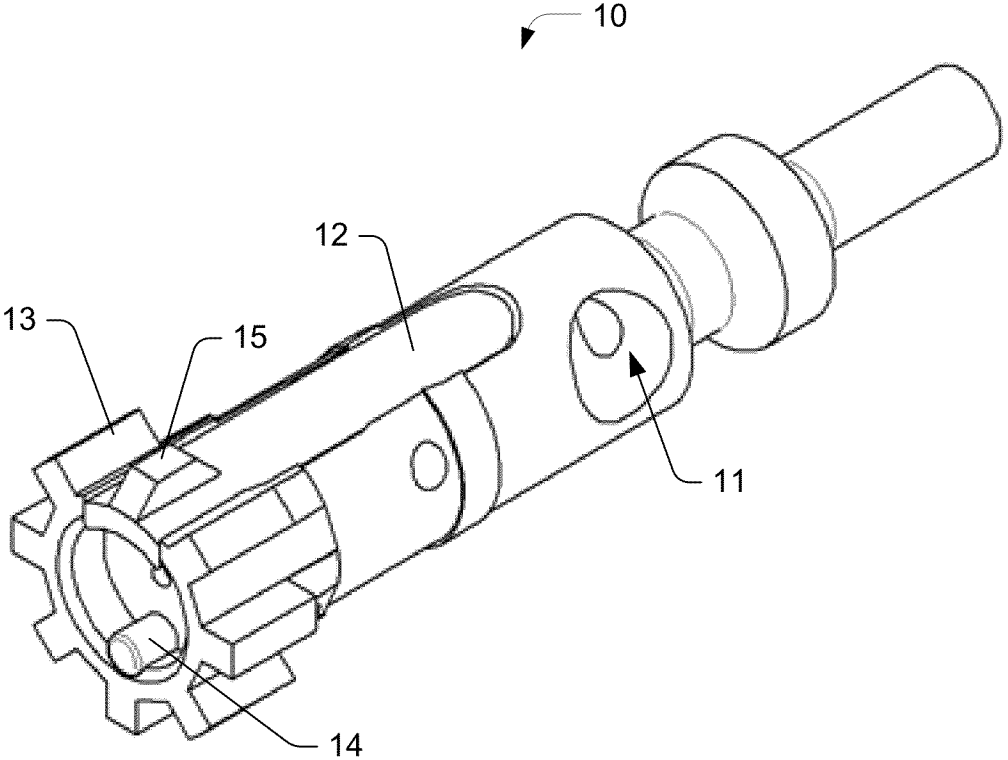
FIG. 1A (PRIOR ART)
FIG. 1A is a perspective view of a standard AR15 bolt assembly.

In the example illustrated in FIG. 2, the new design is derived from the standard AR15 bolt design. Compared to the bolt 10 of FIG. 1, a portion of the bolt front half piece 104 shares identical internal and external geometry as that of the standard AR15 bolt 10 between the bolt head 103 and the end of the extractor slot. Beyond the end of the extractor slot, the new design differs drastically from the standard AR15 bolt assembly 10 of FIG. 1. In particular, other than the bolt front half piece 104, the bolt assembly 100 has three additional pieces, namely, the bolt interlock 106, the bolt interlock return spring 107, and the bolt rear half piece 108. The bolt front half piece 104 houses the extractor 105, ejector 155, extractor spring (not shown), ejector spring (not shown), extractor pin (not shown) and ejector anchor pin (not shown), and all these parts may be identical to that of the AR15 Bolt assembly parts. In the bolt assembly 100, beyond the extractor slot the raised shoulder 109 is added to provide axial stability of the bolt front half piece 104 when it resides inside the bolt carrier assembly 200 (shown in FIG. 7). Beyond the raised shoulder 109, the bolt body profile includes a circumferential groove 156, the position lugs 110 and associated longitudinal grooves 157 that are between adjacent position lugs 110. The position lugs 110 are designed in a way such that the bolt front half piece 104 can be locked with the bolt rear half piece 108 by the bolt interlock 106 in four positions. Among them, three positions are useful for the function of the bolt assembly, which include a left discharge position (FIG. 3A), a right discharge position (FIG. 3C), and an assemble/disassemble position (FIG. 3B). The fourth position (not shown) has no function. The assemble/disassemble position is used when the bolt front half piece 104 is to be assembled with the bolt rear half piece 108, with the bolt interlock 106 and the bolt interlock return spring 107 residing inside the bolt rear half piece 108.

Figure 6:
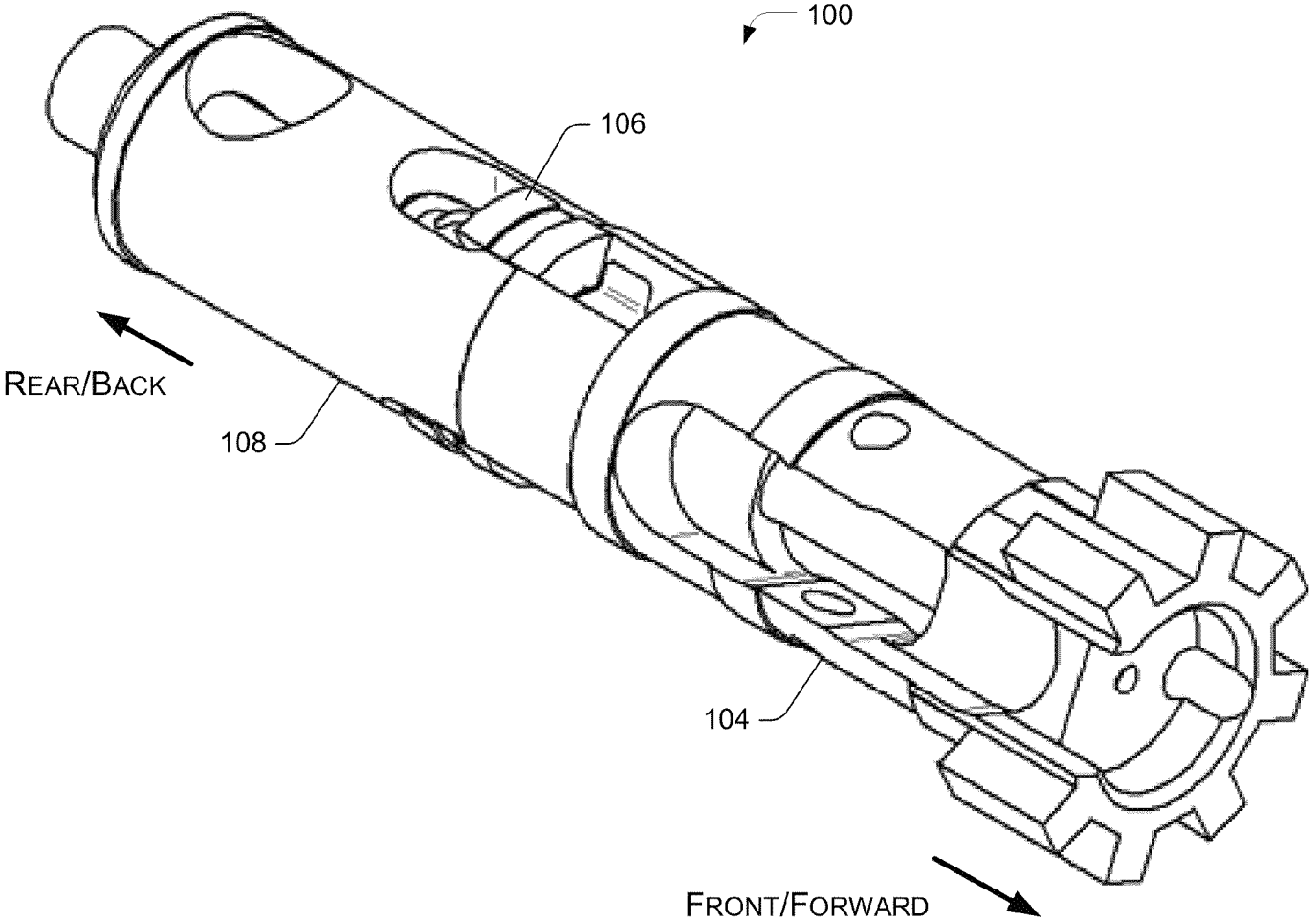
FIG. 6 is a perspective view of a bolt assembly in an open position in accordance with an embodiment of the present disclosure.

The bolt interlock 106 is designed to have a generally cylindrical shape. It has the same number of locking lugs 111 and associated grooves 151 as the position lugs 110 and the associated grooves 157 on the bolt front half piece 104. When the bolt front half piece 104 is in the position shown in FIG. 3A and 3C, the bolt interlock 106 locks the bolt front half piece 104 and the bolt rear half piece 108 under the tension of the bolt interlock return spring 107. The bolt interlock push pin hole 152 of the bolt interlock 106 allows insertion of the bolt interlock push pin 115 (shown in FIG. 7). The through hole 158 of the bolt interlock 106 allows a firing pin 117 (shown in FIG. 7) to pass though. The reduced-diameter shaft 101 of the bolt interlock 106 protrudes out of the back hole 159 of the bolt rear half piece 108 to provide guidance of the bolt interlock 106 when it is moving longitudinally inside the bolt rear half piece 108. The bolt interlock 106 also served as a disposition safety for the firearm, e.g., a rifle, when the bolt front half piece 104 and the bolt rear half piece 108 are not locked together (as shown in FIG. 6).

The bolt rear half piece 108 is designed to have a generally cylindrical shape. On one of the bolt rear half piece 108, longitudinal openings 112 in the bolt rear half piece 108 allow the locking lugs 111 to slide therein, and thereby allowing the bolt interlock 106 to slide longitudinally inside the bolt rear half piece 108. The bolt rear half piece 108 also has circumferential grooves 153 that receive the position lugs 110 of the bolt front half piece 104 such that the bolt front half piece 104 can turn co-axially with the bolt rear half piece 108 but cannot move longitudinally with the bolt rear half piece 108 if the bolt front half piece 104 is not in the assemble/disassemble position as shown in FIG. 3B. One of the longitudinal openings 112 on the bolt rear half piece 108 has an extended portion, or bolt interlock push pin hole 154, which receives the bolt interlock push pin 115 and allows it to move between a locking position and an unlocking position inside of the bolt rear half piece 108. Towards the other end of the bolt rear half piece 108, there is a cam pin hole 113 which receives the cam pin 116 (shown in FIG. 7).

As shown in FIGS. 3A-3C and 4A-4B, the three position lugs 110 of the bolt front half piece 104 are arranged in such a way that in either the left discharge position or the right discharge position, the position lugs 110 can mate with the bolt interlock 106 and the bolt rear half piece 108 in their respective positions shown in FIGS. 4A and 4B.

Figure 5:
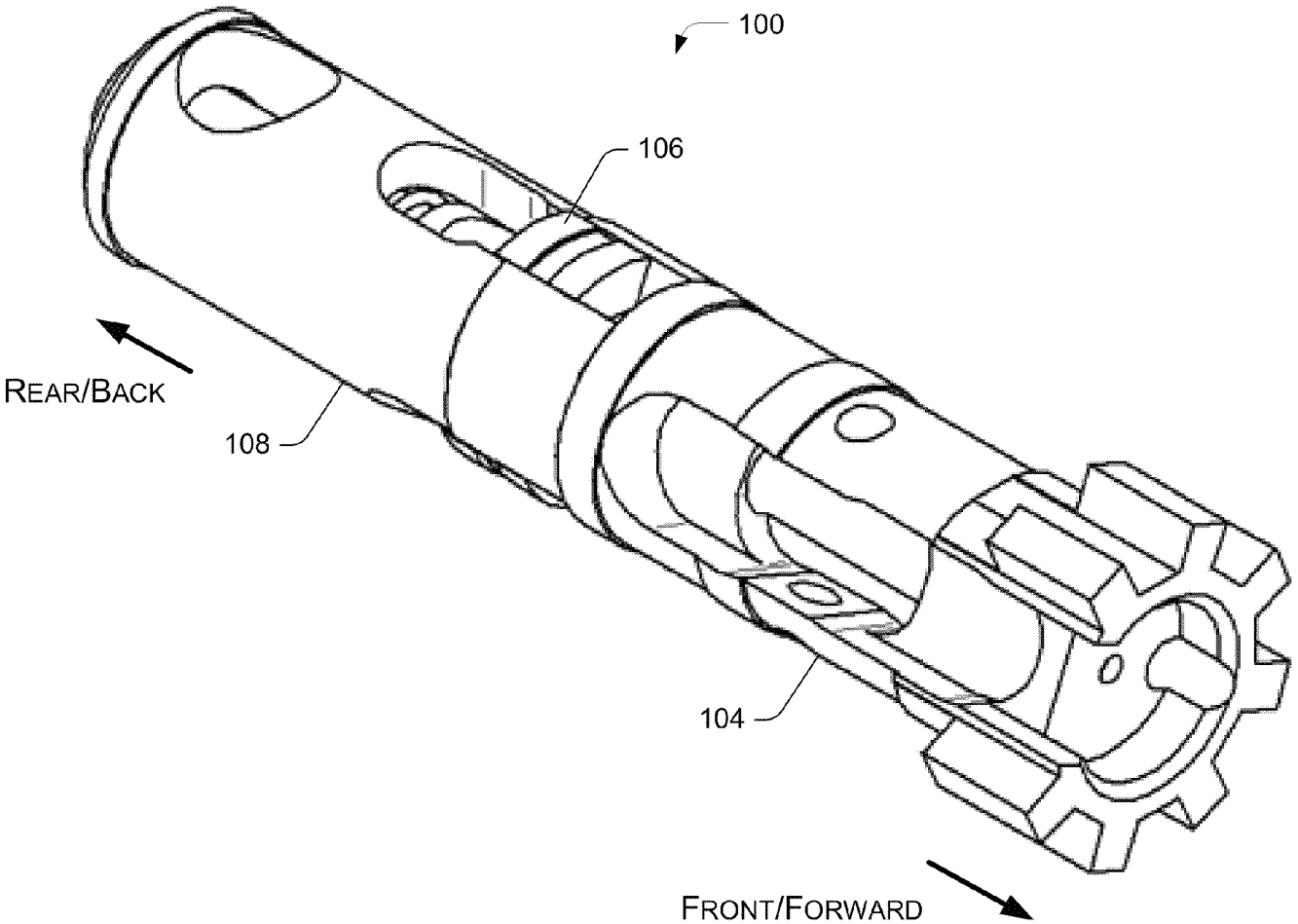
FIG. 5 is a perspective view of a bolt assembly in a locked position in accordance with an embodiment of the present disclosure.

FIG. 5 illustrates the bolt assembly 100 in a locked position in accordance with an embodiment of the present disclosure. When assembled, under the tension of the bolt interlock return spring 107, the bolt interlock 106 can move longitudinally inside the bolt rear half piece 108. As shown in FIG. 5, when the bolt interlock 106 is not pushed by a switch mechanism (shown in FIGS. 10 and 11), the bolt interlock 106 is in an interlocking position such that the bolt front half piece 104 is interlocked axially with respect to the bolt rear half piece 108. Longitudinally, the bolt front half piece 104 and the bolt rear half piece 108 are locked by the three position lugs 110 on the bolt front half piece 104, the grooves 151 on the bolt interlock 106, the circumferential grooves 153 and the longitudinal openings 112 on the bolt rear half piece 108.

FIG. 6 illustrates the bolt assembly 100 in an open position in accordance with the present disclosure. As shown in FIG. 6, when the bolt interlock 106 is pushed all the way back by the switch mechanism until the three position lugs 110 of the bolt front half piece 104 are cleared from the locking lugs 111 of the bolt interlock 106, the bolt front half piece 104 can turn axially within the circumferential grooves 153 of the bolt rear half piece 108, which in turn allows the switch mechanism to change the direction of ejection to eject spent casings out of the bolt assembly 100.

In FIG. 6, the shaft 101 of the bolt interlock 106 protrudes out of the bolt rear half piece 108 (i.e., in the upper-left corner of FIG. 6) further than it does when it is in the locking position as shown in FIG. 5. At this position shown in FIG. 6, the shaft 101 will serve as a disposition safety for the rifle. Hypothetically speaking, if somehow the bolt interlock push pin 115 was released but the bolt interlock 106 failed to lock the bolt front half piece 104 with the bolt rear half piece 108 and the bolt assembly 100 goes back into battery, the locking lugs 103 on the bolt front half piece 104 would not be locking with the locking lugs 21 of the barrel extension 20. If the fresh round in the rifle chamber was fired under this condition, the whole rifle may likely be exploded. However, with the design of the bolt interlock 106 according to the present disclosure, the shaft 101 will push the firing pin out of the reach of the primer of a fresh round in the rifle chamber. Therefore, even if the rifle is fired under the above-described condition, the rounds would not go off and the explosion of the rifle can be prevented.

Example Embodiments of a Bolt Carrier Assembly

According to another aspect, a bolt and bolt carrier assembly for use in a firearm that is capable of selectively ejecting a spent casing in either a first ejection direction or a second ejection direction comprises a bolt assembly and a bolt carrier assembly in which the bolt assembly is received. The bolt assembly comprises: a bolt front half piece having an extractor slot through which the spent casing is ejected; a bolt rear half piece configured to mate with the bolt front half piece; an elastic body received in the bolt rear half piece; and a bolt interlock received in the bolt rear half piece with the elastic body disposed between the bolt interlock and the bolt rear half piece. The bolt interlock is movable longitudinally with respect to the bolt rear half piece. The bolt carrier assembly is configured such that the bolt assembly is movable axially and longitudinally with respect to the bolt carrier assembly between a first bolt assembly position and a second bolt assembly position to allow firing of the firearm when the bolt assembly is in the second bolt assembly position.

In some embodiments, the bolt carrier assembly comprises a bolt carrier, a cam pin, a firing pin, a firing pin retaining pin and a bolt interlock push pin. The bolt carrier includes a bolt hole in which the bolt assembly is received. The bolt carrier further includes a cam groove and a clearance groove defined therein such that the cam groove and the clearance groove connect the bolt hole and an outer circumferential surface of the bolt carrier. The cam pin is movably received in the cam groove of the bolt carrier. The bolt interlock push pin is movably received in the clearance groove of the bolt carrier. The cam groove and the clearance groove are shaped such that the cam pin and the bolt interlock push pin can move axially and longitudinally with respect to the bolt carrier when the cam pin and the bolt interlock push pin are received in the cam groove and the clearance groove, respectively.

In some embodiments, the bolt rear half piece further includes a cam pin hole in which the cam pin, received in the cam groove of the bolt carrier, is inserted. The cam pin includes a clearance hole that receives the bolt interlock when the cam pin is inserted in the cam pin hole of the bolt rear half piece through the cam groove of the bolt carrier. The bolt interlock further includes a bolt interlock push pin hole in which the bolt interlock push pin, received in the clearance groove of the bolt carrier, is inserted.

In some embodiments, the bolt carrier assembly further comprises a firing pin. The bolt interlock push pin includes a clearance hole that receives the firing pin when the bolt interlock push pin is inserted in the bolt interlock push pin hole of the bolt interlock through the clearance groove of the bolt carrier.

Figure 7:
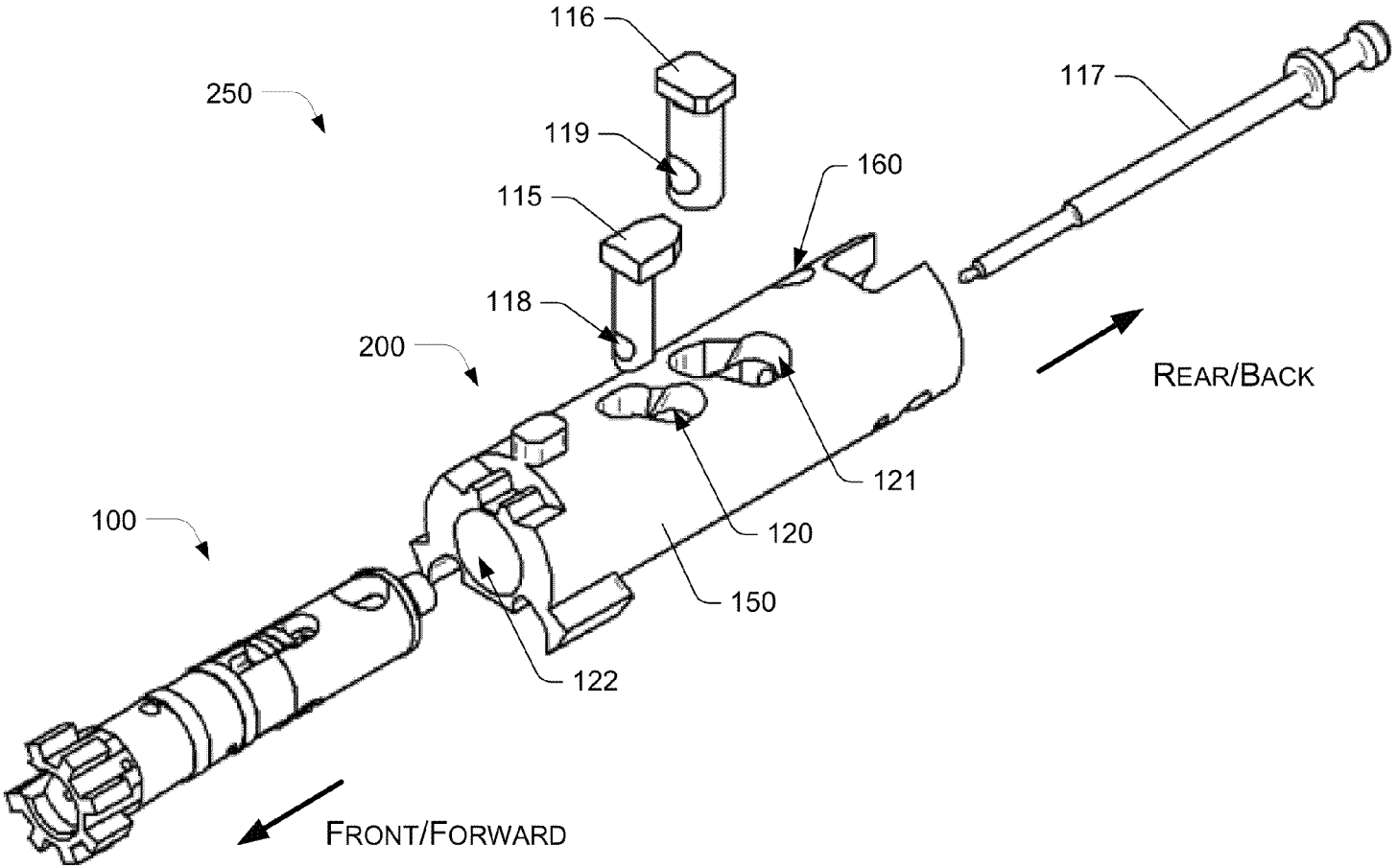
FIG. 7 is an exploded view of a bolt carrier assembly in accordance with an embodiment of the present disclosure.

FIG. 7 illustrates a bolt carrier assembly 200 in accordance with the present disclosure. The bolt carrier assembly 200 comprises a bolt carrier 150, a bolt interlock push pin 115, a cam pin 116, a clearance groove 120 for the bolt interlock push pin 115, a cam groove 121, and a bolt hole 122 in the bolt carrier 150. The bolt carrier assembly 200 may also comprise a firing pin 117 and a firing pin retaining pin (not shown). The bolt interlock push pin 115 comprises a clearance hole 118 for the firing pin 117 to traverse through, and the bolt interlock push pin 115 is received in the clearance groove 120. The cam pin 116 comprises a clearance hole 119 for the shaft 101 of the bolt interlock 106 to traverse through, and the cam pin 116 is received in the cam groove 121.

The bolt assembly 100 is received inside the bolt hole 122 of the bolt carrier 150 and secured by the cam pin 116. On the front end of the bolt carrier 150, there is a clearance cut 161 to accept the bolt gear 130 in the switch mechanism 300, when the bolt assembly 100 is in the locking position with the barrel extension 20. When the bolt head 103 of the bolt assembly 100 rams into the breech surface (not shown) of the barrel extension 20, under the force of the main spring 142, the force of the main spring 142 and the momentum of the bolt carrier assembly 200 will keep the bolt carrier assembly 200 move forward. The cam pin 116 will be forced to rotate, or turn, clockwise as shown in FIG. 7 (looking from the bolt head 103 towards the tail direction of the bolt assembly 100) by the cam hole 121, and the bolt head 103 will be turned accordingly, thereby locking with the breech surface. The rifle will then be safe for firing. Since the bolt interlock push pin 115 is locked with the bolt interlock 106 by the firing pin 117, the bolt interlock push pin 115 will turn accordingly as the whole bolt assembly 100 is turned. Therefore, the clearance groove 120 is designed in the bolt carrier 150 to allow such movement of the bolt interlock push pin 115. On the back end of the bolt carrier assembly 200, there is a firing pin retaining pin hole 160. The firing pin retaining pin (not shown) will be inserted in the firing pin retaining pin hole 160 when the firing pin 117 is installed, in order to retain the firing pin 117 within the bolt carrier assembly 200. The bolt assembly 100 and the bolt carrier assembly 200 together form the bolt and bolt carrier assembly 250, which is shown in FIGS. 8A-8B and FIG. 9.

Figure 8A:
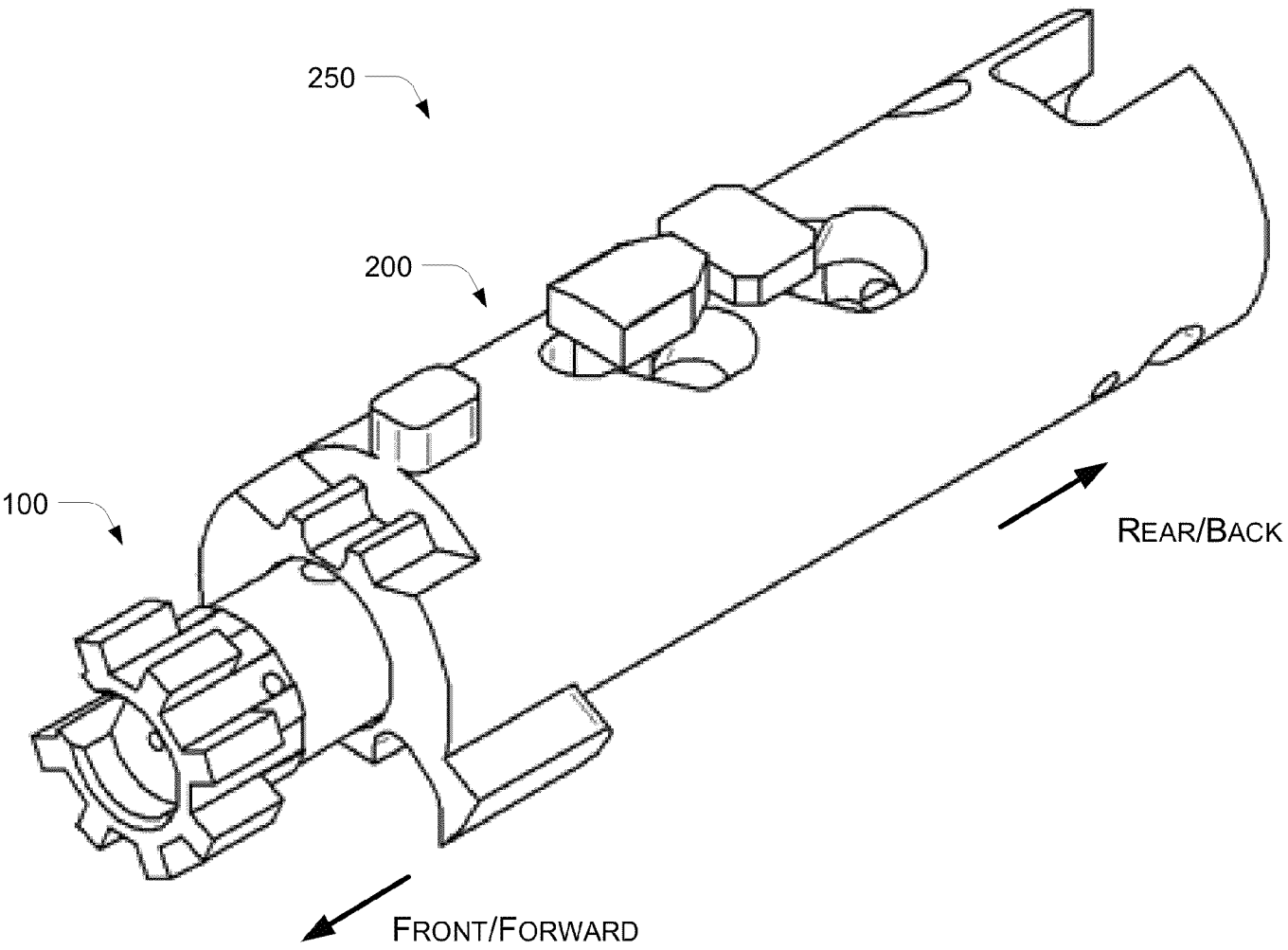
FIG. 8A is a perspective view of a bolt and bolt carrier assembly with the bolt assembly in an unlocking position in accordance with an embodiment of the present disclosure.
Figure 8B:
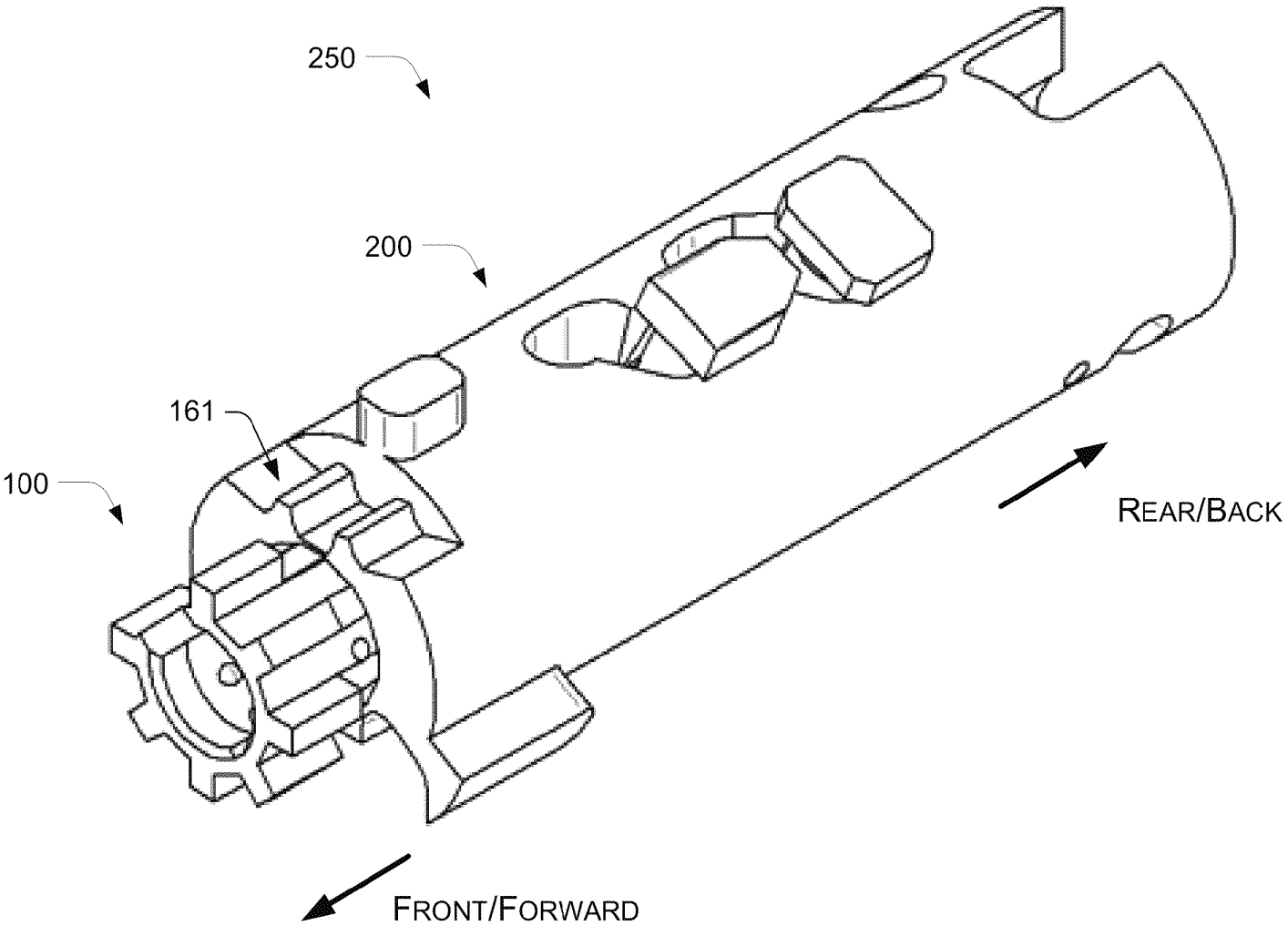
FIG. 8B is a perspective view of a bolt and bolt carrier assembly with the bolt assembly in a locking position in accordance with an embodiment of the present disclosure.
Figure 9:
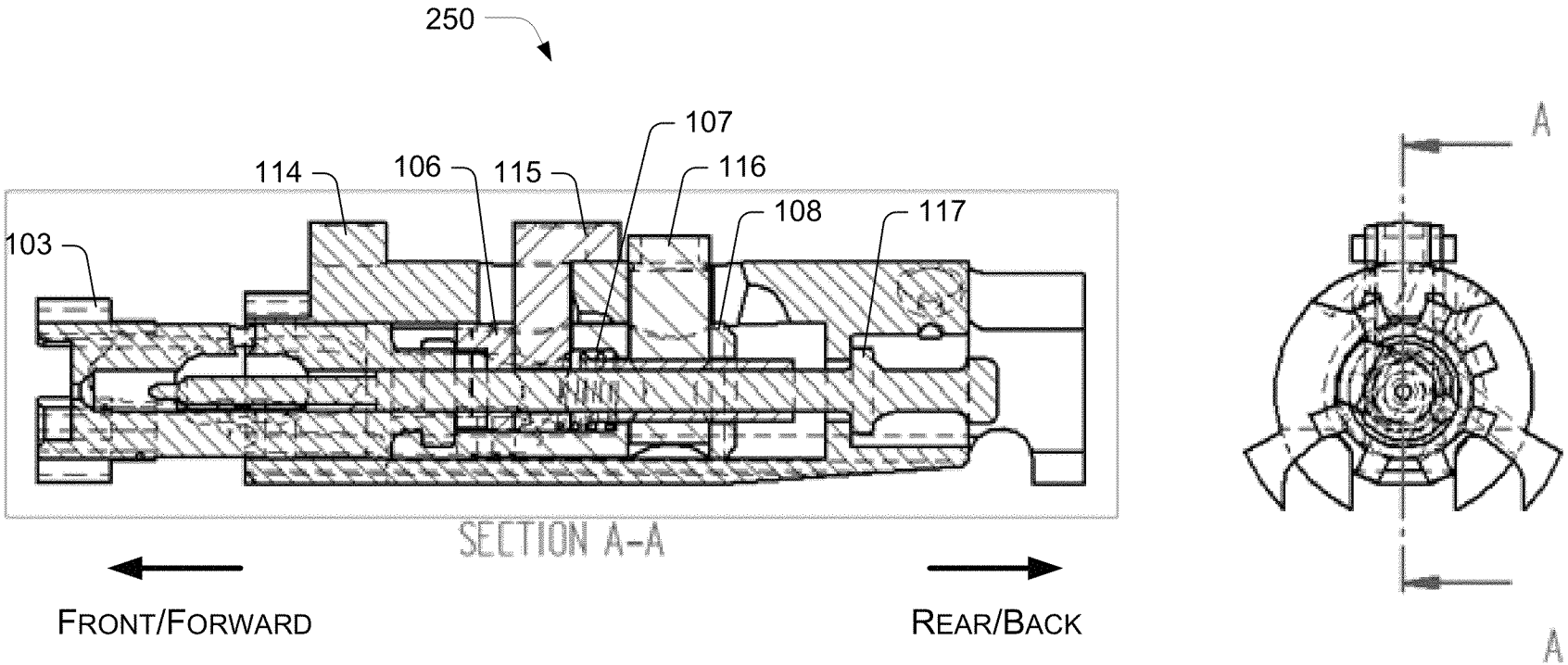
FIG. 9 is a cross-sectional view of a bolt and bolt carrier assembly in accordance with an embodiment of the present disclosure.

FIG. 8A illustrates the bolt and bolt carrier assembly 250 with the bolt assembly 100 in an unlocking position in accordance with the present disclosure. The bolt assembly 100 is in an unlocking position with the barrel extension 20, with the bolt interlock push pin 115 in a pushed-back position. FIG. 8B illustrates the bolt and bolt carrier assembly 250 with the bolt assembly 100 in a locking position in accordance with the present disclosure. The bolt assembly 100 is in a locking position with the barrel extension 20, with the bolt interlock push pin 115 in a released position. FIG. 9 illustrates the bolt and bolt carrier assembly 250 in accordance with the present disclosure.

Example Firearm

According to various embodiments, a firearm capable of selectively ejecting a spent casing in either a first ejection direction or a second ejection direction comprises a bolt assembly, a bolt carrier assembly in which the bolt assembly is received, and a switch mechanism. The bolt assembly comprises: a bolt front half piece having an extractor slot through which the spent casing is ejected; a bolt rear half piece configured to mate with the bolt front half piece; an elastic body received in the bolt rear half piece; and a bolt interlock received in the bolt rear half piece with the elastic body disposed between the bolt interlock and the bolt rear half piece, the bolt interlock movable longitudinally with respect to the bolt rear half piece. The bolt carrier assembly is configured such that the bolt assembly is movable axially and longitudinally with respect to the bolt carrier assembly between a first bolt assembly position and a second bolt assembly position to allow firing of the firearm when the bolt assembly is in the second bolt assembly position. The switch mechanism is coupled to rotate the bolt front half piece axially with respect to the bolt carrier assembly.

In some embodiments, the switch mechanism comprises: an upper receiver; a bolt gear configured to be engaged to the bolt front half piece to rotate the bolt front half piece axially with respect to the bolt carrier assembly; and a first cheekpiece bracket to which the bolt gear is attached. The first cheekpiece bracket has two retention holes. The first cheekpiece bracket is rotatably coupled to the upper receiver such that, when the bolt gear and the bolt front half piece are engaged, by turning the first cheekpiece bracket, the bolt gear turns the bolt front half piece to point the extractor slot in a direction between the first ejection direction and the second ejection direction.

In some embodiments, the switch mechanism further comprises a second cheekpiece bracket, a switch rod, a first switch block, a second switch block, and a switch slide. The second cheekpiece bracket is rotatably coupled to the upper receiver. The second cheekpiece bracket has two retention holes. The switch rod is coupled to move longitudinally with respect to the firearm over the upper receiver. The first switch block is coupled to the switch rod and may have two locking pins. The second switch block is coupled to the switch rod and may have two locking pins. The switch slide is coupled to the switch rod to move longitudinally with respect to the firearm between a first switch slide position and a second switch slide position. When the switch slide is in the first switch slide position, one of the two locking pins of the first switch block and one of the two locking pins of the second switch block are respectively inserted into the respective one of the retention holes of the first cheekpiece bracket and the second cheekpiece bracket, as well as the corresponding retention holes on the upper receiver, to lock the first and second cheekpiece brackets with the upper receiver. When the switch slide is in the second switch slide position, the locking pin of the first switch block and the locking pin of the second switch block are pulled out of the respective one of the retention holes of the first cheekpiece bracket and the second cheekpiece bracket, as well as the respective retention holes on the upper receiver, to allow both the first cheekpiece bracket and the second cheekpiece bracket to rotate.

Figure 10:
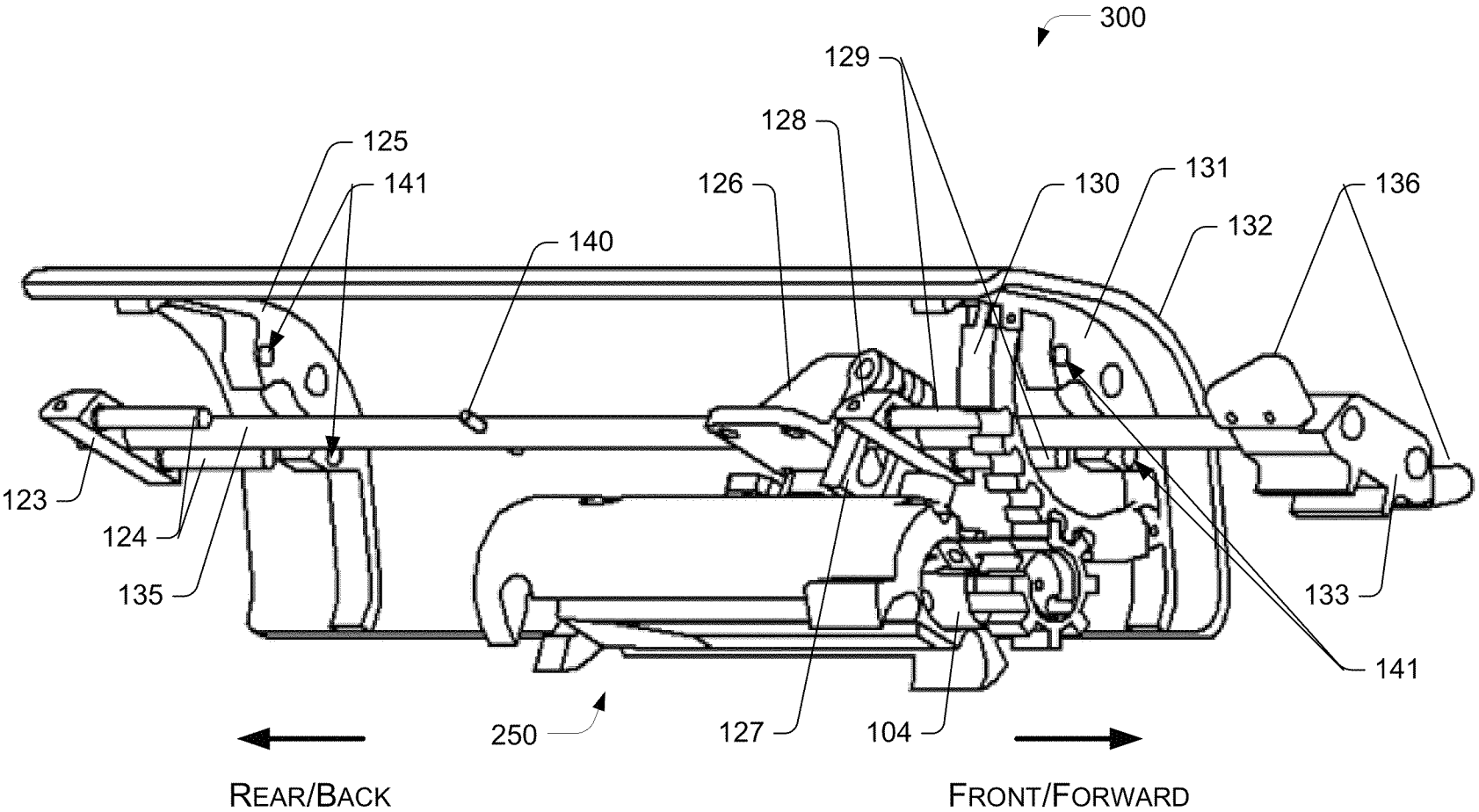
FIG. 10 is a cut-away view of a switch mechanism associated with the bolt carrier assembly in accordance with an embodiment of the present disclosure.
Figure 11:
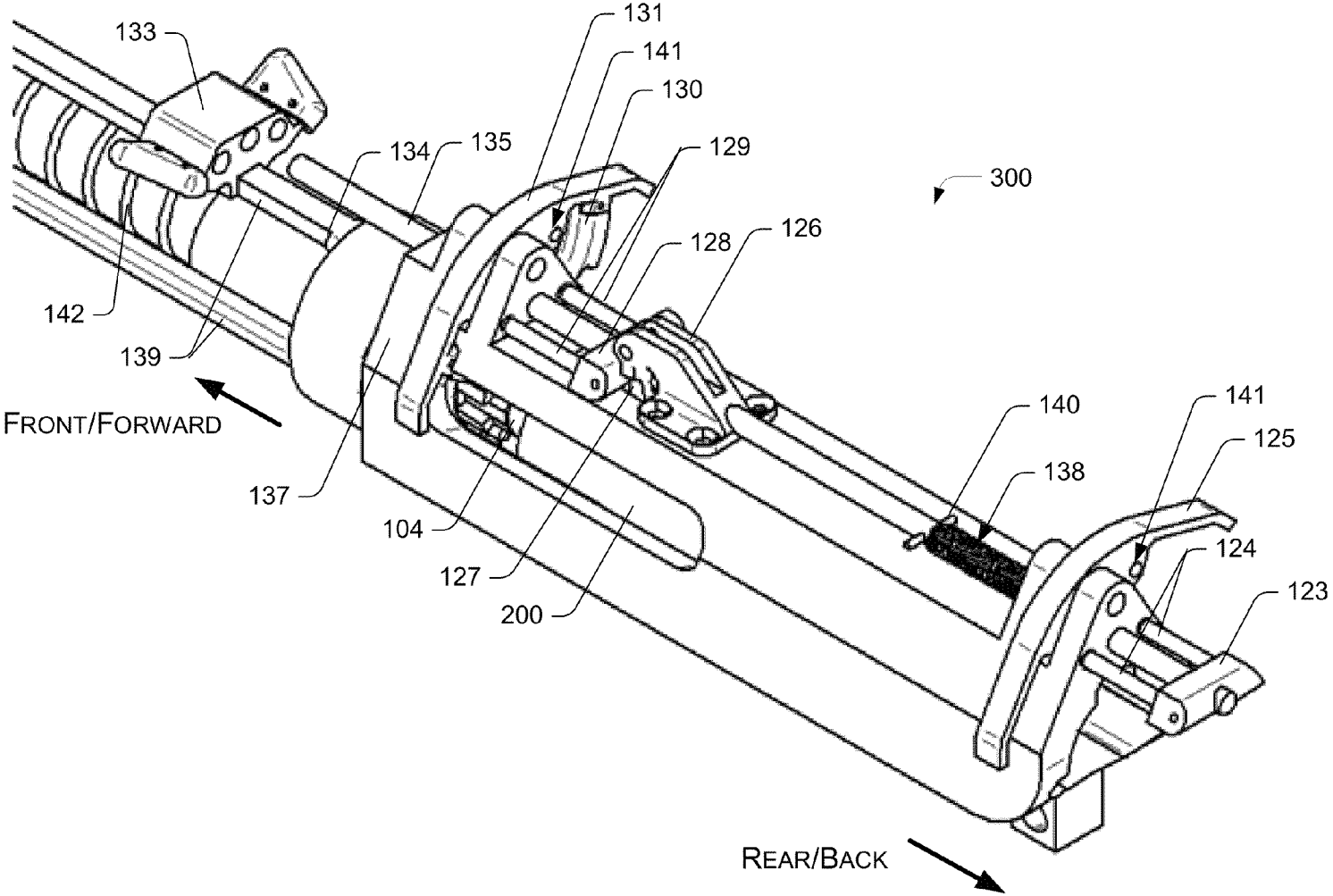
FIG. 11 is a perspective view of a switch mechanism and an upper receiver of a firearm in accordance with an embodiment of the present disclosure.

FIG. 10 is a cut-away view of a switch mechanism 300 associated with the bolt carrier assembly 200 in accordance with an embodiment of the present disclosure. FIG. 11 is a perspective view of the switch mechanism 300 and an upper receiver of a firearm, e.g., a rifle, in accordance with an embodiment of the present disclosure. The switch mechanism 300 comprises an upper receiver 137, a bolt gear 130 configured to be engaged to the bolt head 103 of the bolt front half piece 104 to rotate the bolt front half piece 104 axially with respect to the bolt carrier assembly 200. The switch mechanism 300 also comprises a front cheekpiece bracket 131 to which the bolt gear 130 is attached. The front cheekpiece bracket 131 has at least one retention hole 141. The front cheekpiece bracket 131 is rotatably coupled to the upper receiver 137 such that, when the bolt gear 130 and the bolt front half piece 104 are engaged when the front cheekpiece bracket 131 rotates, the bolt gear 130 turns the bolt front half piece 104 to point the extractor slot 105 in a direction between the first ejection direction and the second ejection direction.

In some embodiments, the switch mechanism 300 further comprises a rear cheekpiece bracket 125, a switch rod 135, a front switch block 128, a rear switch block 123, and a switch slide 133. The rear cheekpiece bracket 125 is rotatably coupled to the upper receiver 137. The rear cheekpiece bracket 125 has at least one retention hole 141. The switch rod 135 is coupled to move longitudinally with respect to the firearm over the upper receiver 137. The front switch block 128 is coupled to the switch rod 135 and has at least one locking pin 129. The rear switch block 123 is coupled to the switch rod 135 and has at least one locking pin 124. The switch slide 133 is coupled to the switch rod 135 to move longitudinally with respect to the firearm between a first switch slide position and a second switch slide position.

As shown in FIG. 10, a bolt gear 130 is employed to rotate, or turn, the bolt front half piece 104 clockwise or counterclockwise when the bolt interlock 106 (not shown in FIG. 10) is pushed back. The bolt gear 130 is attached to the front cheekpiece bracket 131 by two roller pins (not shown) located on each end of the bolt gear 130. The front cheekpiece bracket 131 and the rear cheekpiece bracket 125 are mounted on the upper receiver 137 (not shown in FIG. 10).

As shown in FIG. 11, the switch mechanism 300 is located on top of a piston rod 139 and the upper receiver 137. The switch mechanism 300 includes a switch slide 133, two switch slide levers 136 (left and right on the switch slide 133), a switch rod 135, a front switch block 128, a rear switch block 123, a switch return spring 138 and its retaining pin 140. When the switch mechanism 300 is in a first slide position, one of the locking pins 124 or 129 on the front and rear switch blocks 123, 128 will rest on one of the respective retention holes 141 of the front and rear cheekpiece brackets 125, 131 to lock the front and rear cheekpiece brackets 125, 131 with the upper receiver 137. When the operator/shooter pushes back the switch slide 133 with the switch slide levers 136, it will move backward together with the switch rod 135 and the front and rear switch blocks 123, 128. The back side of the switch slide 133 will contact with the detent surface 134 on the piston rod 139, hence pushing back the piston rod 139 and the connected bolt carrier assembly 200. The bolt carrier 150 will unlock the bolt head 103 with the barrel extension (not shown), move it out of the barrel extension and mate with the bolt gear 130. At the same time, the front switch block 128 will push the interlock push lever 127, which pivot on the interlock push level base 126 to rotate backward and make it in contact with the bolt interlock push pin 115, and push the bolt interlock 106 backward inside the bolt rear half piece 108.

Due to the distance between the pivoting point on the interlock push lever 127 and the contact point of it with the interlock push pin 115 being greater than the distance between the pivoting point on the interlock push lever 127 and the contact point of it with the front switch block 128, and that the front switch block 128 is moving at the same displacement as that of the bolt carrier assembly 200, starting from the time that the interlock push lever 127 is in contact with the bolt interlock push pin 115, as the interlock push lever 127 turns more, the bolt interlock push pin 115 will be pushed backward in relation to the bolt carrier assembly 200. At certain position, the bolt interlock 106 will be pushed all the way back to clear its lock lugs 111 out of the circumferential grooves 153 (as shown in FIG. 6). The location of the interlock push lever base 126 is designed to ensure that when the bolt head 103 is fully out of the barrel extension and mated with the bolt gear 130, the bolt interlock 106 is pushed fully backward so that the bolt front half piece 104 can be turned. Simultaneously, the locking pins 124 and 129 on the front and rear switch blocks 123 and 128 are also moved out of the locking holes 141 of the front and rear cheekpiece brackets 125 and 131 to allow the front cheekpiece brackets 125, the rear cheekpiece 131, and the bolt gear 130 to turn freely. At this moment, the operator of the firearm could turn the cheekpiece 132, which is mounted on top of the front and rear switch brackets 125 and 131, to change the ejection direction of the spent casings/cartridges.

After the change of direction is completed, the operator can release the switch slide levers 136. Before the bolt assembly 100 is pushed back into battery, the interlock push lever 127 will be pushed forward and upward both by the movement of the bolt carrier assembly 200 and the interlock push lever return spring (not shown, a torsion spring installed on the interlock push lever base 126) hence allowing the bolt interlock return spring 107 to push the bolt interlock 106 back into the locking position to lock the bolt front half piece 104 and the bolt rear half piece 108 together. The slide rod return spring 138 will push the slide rod 135 into the first slide position. Resultantly, the locking pins 124 and 129 on the front and rear switch blocks 123 and 128 will lock the front and rear cheekpiece brackets 125 and 131 with the upper receiver 137. Meanwhile, the main spring 142 of the firearm will push the bolt carrier assembly 200 back into battery. At this time the firearm can be fired again.

Figure 12:
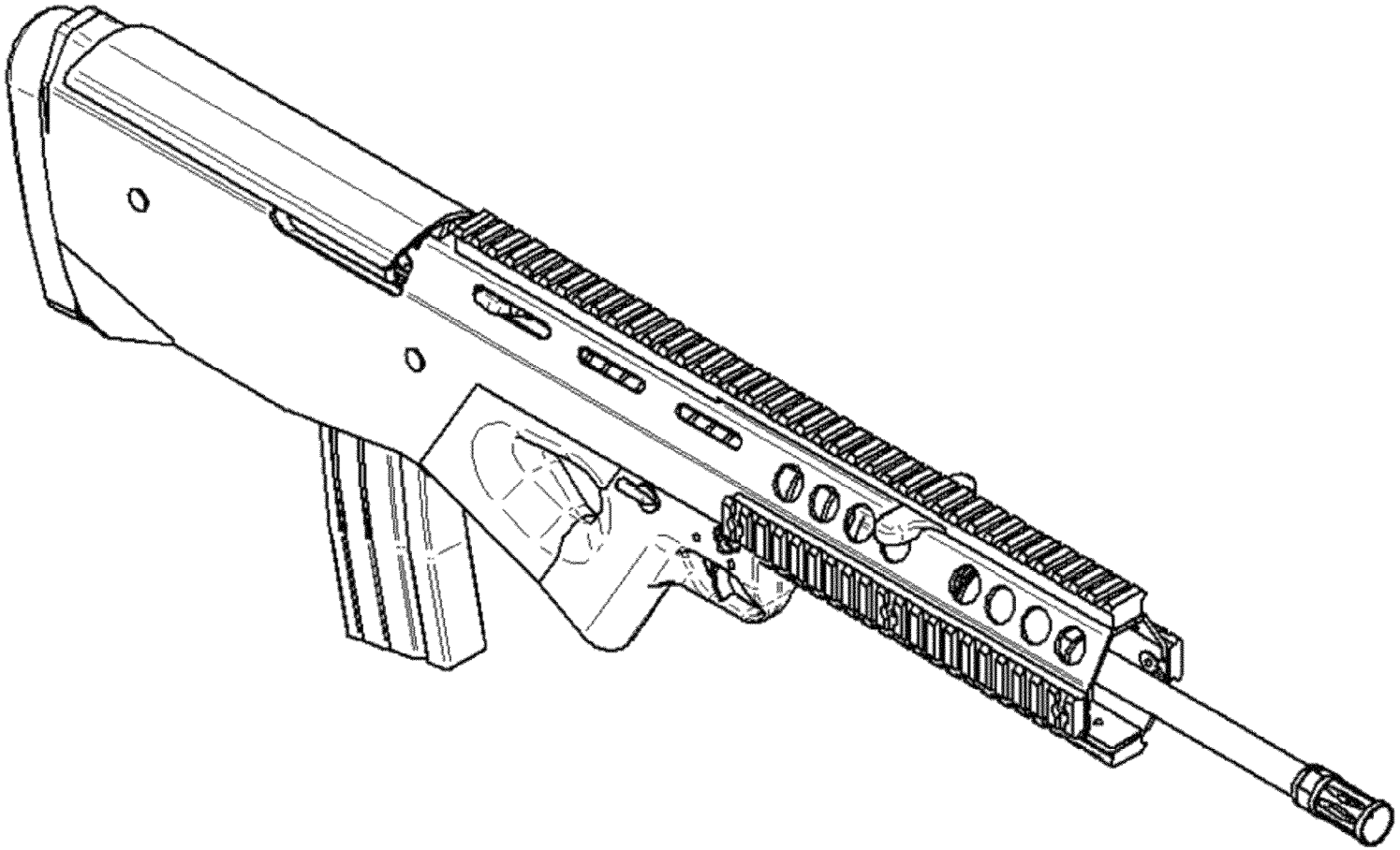
FIG. 12 is an example of the design of the present disclosure applied to a bullpup rifle with the rifle discharging spent bullet casings from the right side of the rifle.
Figure 13:
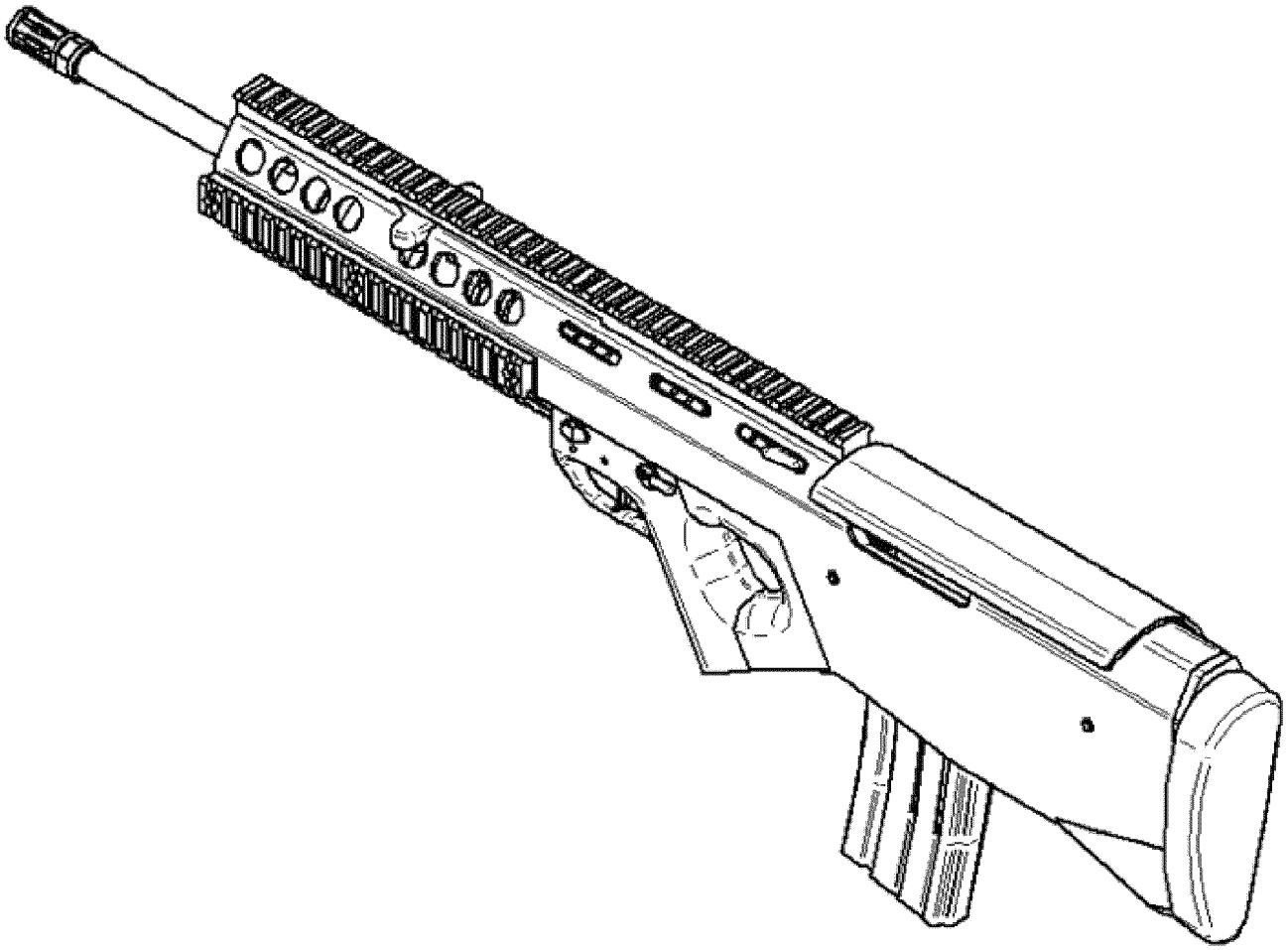
FIG. 13 is an example of the design of the present disclosure applied to the bullpup rifle of FIG. 12 with the rifle discharging spent bullet casings from the left side of the rifle.

FIG. 12 illustrates an example of the design of the present disclosure applied to a bullpup rifle with the rifle discharging spent bullet casings from the right side of the rifle. FIG. 13 illustrates an example of the design of the present disclosure applied to the bullpup rifle of FIG. 12 with the rifle discharging spent bullet casings from the left side of the rifle.

Conclusion

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims and their equivalents.

What is claimed is:

1. A bolt assembly for use in a firearm that is capable of selectively ejecting a spent casing in either a first ejection direction or a second ejection direction, the bolt assembly comprising:

a bolt front half piece having an extractor slot capable of extracting and ejecting the spent casing;

a bolt rear half piece configured to mate with the bolt front half piece;

an elastic body received in the bolt rear half piece; and a bolt interlock received in the bolt rear half piece and movable longitudinally with respect to the bolt rear half piece such that, when the bolt front half piece and the bolt rear half piece are mated together with the elastic body disposed between the bolt interlock and the bolt rear half piece:

when the bolt interlock is in a first bolt interlock position, the bolt front half piece is interlocked axially with respect to the bolt rear half piece by the bolt interlock to eject the spent casing in the first ejection direction; and when the bolt interlock is in a second bolt interlock position, the bolt front half piece is rotatable axially with respect to the bolt rear half piece to eject the spent casing in the second ejection direction which is different from the first ejection direction.

2. A bolt assembly of claim 1, wherein, when in the second bolt interlock position, the bolt interlock functions as a disposition safety to distance a firing pin of the firearm away from an ammunition primer in an event the bolt assembly is in a battery position with a barrel extension of the firearm.

3. A bolt assembly of claim 1, wherein the bolt front half piece further comprises:

a bolt head defined at a first end of the bolt front half piece;

a plurality of position lugs defined at a second end of the bolt front half piece opposite the first end; and a raised shoulder circling a circumference of the bolt front half piece and defined between the extractor slot and the position lugs.

4. A bolt assembly of claim 3, wherein the bolt interlock comprises:

a body generally cylindrical in shape and having a first end and a second end opposite the first end, the first end in contact with the bolt front half piece when the bolt interlock is in the first bolt interlock position; and a plurality of interlocking lugs at the first end of the body with a plurality of grooves defined therebetween, the grooves receiving the position lugs of the bolt front half piece to interlock the bolt front half piece axially with respect to the bolt rear half piece when the bolt interlock is in the first bolt interlock position.

5. A bolt assembly of claim 4, wherein the bolt rear half piece is generally cylindrical in shape and hollow, a first end of the bolt rear half piece that mates with the bolt front half piece having an opening that receives the bolt interlock, the bolt rear half piece having a plurality of longitudinal openings extending from the opening at the first end toward a second end opposite the first end for a portion of a length of the bolt rear half piece so that the interlocking lugs of the bolt interlock slide in the longitudinal openings when the bolt interlock move between the first bolt interlock position and the second bolt interlock position.

6. A bolt assembly of claim 4, wherein the bolt front half piece comprises three position lugs, and wherein the bolt interlock comprises three interlocking lugs.

7. A bolt and bolt carrier assembly for use in a firearm that is capable of selectively ejecting a spent casing in either a first ejection direction or a second ejection direction, the bolt and bolt carrier assembly comprising:

a bolt assembly, the bolt assembly comprising:

a bolt front half piece having an extractor slot through which the spent casing is ejected;

a bolt rear half piece configured to mate with the bolt front half piece;

an elastic body received in the bolt rear half piece; and a bolt interlock received in the bolt rear half piece with the elastic body disposed between the bolt interlock and the bolt rear half piece, the bolt interlock movable longitudinally with respect to the bolt rear half piece; and a bolt carrier assembly in which the bolt assembly is received, the bolt carrier assembly configured such that the bolt assembly is movable axially and longitudinally with respect to the bolt carrier assembly between a first bolt assembly position and a second bolt assembly position to allow firing of the firearm when the bolt assembly is in the second bolt assembly position.

8. A bolt and bolt carrier assembly of claim 7, wherein, when the bolt interlock is in a first bolt interlock position, the bolt front half piece is interlocked axially with respect to the bolt rear half piece by the bolt interlock with the extractor slot pointing in the first ejection direction, and wherein, when the bolt interlock is in a second bolt interlock position, the bolt front half piece is rotatable axially with respect to the bolt rear half piece so that the extractor slot can point in the second ejection direction which is different from the first ejection direction.

9. A bolt and bolt carrier assembly of claim 7, wherein the bolt front half piece further comprises:

a bolt head defined at a first end of the bolt front half piece;

a plurality of position lugs defined at a second end of the bolt front half piece opposite the first end; and a raised shoulder circling a circumference of the bolt front half piece and defined between the extractor slot and the position lugs.

10. A bolt and bolt carrier assembly of claim 9, wherein the bolt interlock comprises:

a body generally cylindrical in shape and having a first end and a second end opposite the first end, the first end in contact with the bolt front half piece when the bolt interlock is in the first bolt interlock position; and a plurality of interlocking lugs at the first end of the body with a plurality of grooves defined therebetween, the grooves receiving the position lugs of the bolt front half piece to interlock the bolt front half piece axially with respect to the bolt rear half piece when the bolt interlock is in the first bolt interlock position.

11. A bolt and bolt carrier assembly of claim 10, wherein the bolt rear half piece is generally cylindrical in shape and hollow, a first end of the bolt rear half piece that mates with the bolt front half piece having an opening that receives the bolt interlock, the bolt rear half piece having a plurality of longitudinal openings extending from the opening at the first end toward a second end opposite the first end for a portion of a length of the bolt rear half piece so that the interlocking lugs of the bolt interlock slide in the longitudinal openings when the bolt interlock move between the first bolt interlock position and the second bolt interlock position.

12. A bolt and bolt carrier assembly of claim 7, wherein the bolt carrier assembly comprises:

a bolt carrier having a bolt hole in which the bolt assembly is received, the bolt carrier further having a cam groove and a clearance groove defined therein such that the cam groove and the clearance groove connect the bolt hole and an outer circumferential surface of the bolt carrier;

a cam pin movably received in the cam groove of the bolt carrier; and a bolt interlock push pin movably received in the clearance groove of the bolt carrier, wherein the cam groove and the clearance groove are shaped such that the cam pin and the bolt interlock push pin can move axially and longitudinally with respect to the bolt carrier when the cam pin and the bolt interlock push pin are received in the cam groove and the clearance groove, respectively.

13. A bolt and bolt carrier assembly of claim 12, wherein the bolt rear half piece further includes a cam pin hole in which the cam pin, received in the cam groove of the bolt carrier, is inserted, wherein the cam pin includes a clearance hole that receives the bolt interlock when the cam pin is inserted in the cam pin hole of the bolt rear half piece through the cam groove of the bolt carrier, and wherein the bolt interlock further includes a bolt interlock push pin hole in which the bolt interlock push pin, received in the clearance groove of the bolt carrier, is inserted.

14. A bolt and bolt carrier assembly of claim 12, wherein the bolt carrier assembly further comprises a firing pin, and wherein the bolt interlock push pin includes a clearance hole that receives the firing pin when the bolt interlock push pin is inserted in the bolt interlock push pin hole of the bolt interlock through the clearance groove of the bolt carrier.

15. A firearm capable of selectively ejecting a spent casing in either a first ejection direction or a second ejection direction, the firearm comprising:

a bolt assembly, the bolt assembly comprising:

a bolt front half piece having an extractor slot through which the spent casing is ejected;

a bolt rear half piece configured to mate with the bolt front half piece;

an elastic body received in the bolt rear half piece; and a bolt interlock received in the bolt rear half piece with the elastic body disposed between the bolt interlock and the bolt rear half piece, the bolt interlock movable longitudinally with respect to the bolt rear half piece;

a bolt carrier assembly in which the bolt assembly is received, the bolt carrier assembly configured such that the bolt assembly is movable axially and longitudinally with respect to the bolt carrier assembly between a first bolt assembly position and a second bolt assembly position to allow firing of the firearm when the bolt assembly is in the second bolt assembly position; and a switch mechanism coupled to rotate the bolt front half piece axially with respect to the bolt carrier assembly.

16. A firearm of claim 15, wherein, when the bolt interlock is in a first bolt interlock position, the bolt front half piece is interlocked axially with respect to the bolt rear half piece by the bolt interlock with the extractor slot pointing in the first ejection direction, and wherein, when the bolt interlock is in a second bolt interlock position, the bolt front half piece is rotatable axially with respect to the bolt rear half piece so that the extractor slot can point in the second ejection direction which is different from the first ejection direction.

17. A firearm of claim 15, wherein the bolt front half piece further comprises:

a bolt head defined at a first end of the bolt front half piece;

a plurality of position lugs defined at a second end of the bolt front half piece opposite the first end; and a raised shoulder circling a circumference of the bolt front half piece and defined between the extractor slot and the position lugs.

18. A firearm of claim 17, wherein the bolt interlock comprises:

a body generally cylindrical in shape and having a first end and a second end opposite the first end, the first end in contact with the bolt front half piece when the bolt interlock is in the first bolt interlock position; and a plurality of interlocking lugs at the first end of the body with a plurality of grooves defined therebetween, the grooves receiving the position lugs of the bolt front half piece to interlock the bolt front half piece axially with respect to the bolt rear half piece when the bolt interlock is in the first bolt interlock position.

19. A firearm of claim 18, wherein the bolt rear half piece is generally cylindrical in shape and hollow, a first end of the bolt rear half piece that mates with the bolt front half piece having an opening that receives the bolt interlock, the bolt rear half piece having a plurality of longitudinal openings extending from the opening at the first end toward a second end opposite the first end for a portion of a length of the bolt rear half piece so that the interlocking lugs of the bolt interlock slide in the longitudinal openings when the bolt interlock move between the first bolt interlock position and the second bolt interlock position.

20. A firearm of claim 15, wherein the switch mechanism comprises:

an upper receiver;

a bolt gear configured to be engaged to the bolt front half piece to rotate the bolt front half piece axially with respect to the bolt carrier assembly; and a first cheekpiece bracket to which the bolt gear is attached, the first cheekpiece bracket having two retention holes, the first cheekpiece bracket rotatably coupled to the upper receiver such that, when the bolt gear and the bolt front half piece are engaged, by turning the first cheekpiece bracket, the bolt gear turns the bolt front half piece to point the extractor slot in a direction between the first ejection direction and the second ejection direction.

21. A firearm of claim 20, wherein the switch mechanism further comprises:

a second cheekpiece bracket rotatably coupled to the upper receiver, the second cheekpiece bracket having two retention holes;

a switch rod coupled to move longitudinally with respect to the firearm over the upper receiver;

a first switch block coupled to the switch rod and having two locking pins;

a second switch block coupled to the switch rod and having two locking pins; and a switch slide coupled to the switch rod to move longitudinally with respect to the firearm between a first switch slide position and a second switch slide position such that:

when the switch slide is in the first switch slide position, one of the two locking pins of the first switch block and one of the two locking pins of the second switch block are respectively inserted a respective one of the retention holes of the first cheekpiece bracket and the second cheekpiece bracket to lock the first and second cheekpiece brackets with the upper receiver; and when the switch slide is in the second switch slide position, the one of the two locking pins of the first switch block and the one of the two locking pins of the second switch block are pulled out of the respective one of the retention holes of the first cheekpiece bracket and the second cheekpiece bracket to allow the first cheekpiece bracket and the second cheekpiece bracket to rotate.

* * * * *